US008421691B2

(12) United States Patent
Noguchi et al.

(10) Patent No.: US 8,421,691 B2
(45) **Date of Patent: *Apr. 16, 2013**

(54) VEHICULAR GLASS ANTENNA

(75) Inventors: Akihiro Noguchi, Mie (JP); Yasuo Takaki, Matsusaka (JP); Yuji Katada, Matsusaka (JP)

(73) Assignee: Central Glass Company, Limited, Ube-shi (JP)

( * ) Notice: Subject to any disclaimer, the term of this patent is extended or adjusted under 35 U.S.C. 154(b) by 276 days.

This patent is subject to a terminal disclaimer.

(21) Appl. No.: 12/867,201

(22) PCT Filed: Jan. 26, 2009

(86) PCT No.: PCT/JP2009/051174

§ 371 (c)(1),
(2), (4) Date: Aug. 11, 2010

(87) PCT Pub. No.: WO2010/038485

PCT Pub. Date: Apr. 8, 2010

(65) Prior Publication Data

US 2011/0032163 A1 Feb. 10, 2011

(30) Foreign Application Priority Data

Oct. 2, 2008 (JP) ..... 2008-257782
Oct. 2, 2008 (JP) ..... 2008-257783
Jan. 19, 2009 (JP) ..... 2009-008824

(51) Int. Cl.
*H01Q 1/32* (2006.01)
*H01Q 1/02* (2006.01)

(52) U.S. Cl.
USPC ..... 343/704; 343/712; 343/713

(58) Field of Classification Search ..... 343/712, 343/713, 711, 704
See application file for complete search history.

(56) References Cited

U.S. PATENT DOCUMENTS 5,581,264 A * 12/1996 Tabata et al. ..... 343/713
6,072,435 A 6/2000 Terashima et al.
(Continued)

FOREIGN PATENT DOCUMENTS

JP 2-13311 U 1/1990
JP 11-205023 A 7/1999
(Continued)

OTHER PUBLICATIONS

International Search Report with English translation dated May 12, 2009 (Five (5) pages).

*Primary Examiner* — Michael C Wimer
*Assistant Examiner* — Amal Patel
(74) *Attorney, Agent, or Firm* — Crowell & Moring LLP

(57) ABSTRACT

A vehicular glass antenna is provided. The antenna includes an AM broadcast wave receiving antenna having a plurality of horizontal strips and at least two vertical strips with an AM feed point between the vertical strips on the uppermost horizontal strip or through a line extending from the uppermost horizontal strip, and two FM broadcast wave receiving antennas extending from two FM feed points provided above uppermost horizontal strip of the AM antenna along a part of an outermost portion of the AM broadcast wave receiving antenna. The FM antennas extend in opposite clockwise and counterclockwise directions. The FM antennas have a substantially U-shape surrounding the ends of the AM antenna horizontal strips on their respective sides, and include a second horizontal strip adjacent to the horizontal strips of the AM antenna to achieve capacitive coupling.

24 Claims, 10 Drawing Sheets

U.S. PATENT DOCUMENTS

| | | | | |
|---|---|---|---|---|
| 6,243,043 | B1 | 6/2001 | Terashima et al. | |
| 7,091,914 | B2 * | 8/2006 | Noguchi et al. | 343/713 |
| 7,456,796 | B2 | 11/2008 | Nagayama et al. | |
| 7,825,865 | B2 * | 11/2010 | Ibe et al. | 343/713 |
| 2004/0008144 | A1 | 1/2004 | Kubota | |
| 2005/0030235 | A1 | 2/2005 | Noguchi et al. | |
| 2007/0273597 | A1 * | 11/2007 | Noda | 343/713 |
| 2008/0106480 | A1 * | 5/2008 | Nagayama et al. | 343/713 |

FOREIGN PATENT DOCUMENTS

| | | | |
|---|---|---|---|
| JP | 2004-88748 | A | 3/2004 |
| JP | 2005-26905 | A | 1/2005 |
| JP | 2006-33050 | A | 2/2006 |
| JP | 2006-197184 | A | 7/2006 |
| JP | 2006-311499 | A | 11/2006 |
| WO | WO 2006103956 | A1 * | 10/2006 |

* cited by examiner

VEHICULAR GLASS ANTENNA

TECHNICAL FIELD

The present invention relates to a glass antenna that is formed on a rear window glass of vehicles such as an automobiles, and that includes separates antennas of an AM radio broadcast wave receiving antenna and an FM radio broadcast wave receiving antenna, particularly to a glass antenna that is suitable for receiving radio waves of FM broadcast waves for Japanese domestic use and for use outside Japan.

BACKGROUND OF THE INVENTION

Hitherto, glass antennas for receiving AM radio broadcast waves and FM radio broadcast waves are often formed on a rear window glass of an automobile, since it requires a relatively large area for obtaining a good reception gain. Furthermore, the rear window glass of the automobile is often formed on its central region with defogging heater strips for ensuring rear visibility at the driving in rain. Accordingly, in case that the glass antenna is formed on the rear window glass, it has been forced to be formed on a blank space above or below the defogging heater strips.

Furthermore, in most cases, one antenna provided on the blank space above the defogging heater strips has been received radio waves of AM radio broadcast waves and radio waves of FM radio broadcast waves. This antenna of the AM radio-band/FM radio-band has been a grounded antenna pattern having one common feed point.

Furthermore, in case of receiving the radio waves of the AM radio broadcast waves and the radio waves of the FM radio broadcast waves by one glass antenna, in many cases, an antenna amplifier has been provided generally between an antenna feed point and a tuner so as to amplify an electromotive force insufficient to be input to the tuner, and, it has been input to the tuner.

Alternatively, an impedance matching circuit has been formed in order to minimize the reduction loss of the reception gain by a feeder line between the antenna feed point and the tuner to maintain the electromotive force to become sufficient to be input to the tuner, thereby inputting it to the tuner.

In the case of sharing antennas of the AM broadcast waves and the FM broadcast waves, in many cases, with respect to the amplifier, an AM broadcast wave amplifier and an FM broadcast wave amplifier are separately provided, thereby amplifying the received power and then inputting it to the tuner. Alternatively, also with respect to the impedance matching circuit, in many cases, the reduction due to the loss of the reception sensitivity is suppressed by an AM broadcast wave impedance matching circuit and an FM broadcast wave impedance matching circuit in the route that the radio waves received by the antenna are transmitted to the tuner.

As one in which a glass antenna is formed on an upper blank space of a vehicular rear window glass and an amplification is conducted by an amplifier, for example, there is described a microfilm of Japanese Utility Model Application No. 63-89982 (Japanese Utility Model Laid-open Publication No. 2-13311) an amplifier attachment structure of a vehicular glass antenna, which has a glass antenna in which an antenna conductor is formed at a predetermined position of a vehicular window glass sheet, and an amplifier for amplifying the reception sensitivity of the glass antenna, and in which the amplifier is directly connected to a feed terminal portion of the glass antenna by means such as soldering, brazing or a conductive adhesive bonding, thereby reducing the gain loss due to the capacity loss at a feed line portion between the glass antenna and the amplifier (A Patent Document 1).

In a vehicular glass antenna in Japanese Patent Application Publication No. 11-205023, there are provided a first coil, a second coil, a first antenna conductor provided in a window glass sheet of a vehicle, and a second antenna conductor provided in the window glass sheet of the vehicle. This glass antenna generates first resonance including, as resonance elements, impedance of the first antenna conductor and inductance of the first coil, and generates second resonance including, as resonance elements, impedance of the second antenna conductor and inductance of the second coil. The second antenna conductor has a length and a shape of the conductor for a first received frequency band. The first antenna conductor has a length and a shape of the conductor for a second received frequency band higher in the frequency than the first received frequency band. A resonance frequency of the first resonance and a resonance frequency of the second resonance are, respectively, frequencies to improve the sensitivity of the first received frequency band. The first antenna conductor and the second antenna conductor are electrically connected with each other (A Patent Document 2).

Patent Document 1: a microfilm of Japanese Utility Model Application No. 63-89982 (Japanese Utility Model Laid-open Publication No. 2-13311)

Patent Document 2: Japanese Patent Application Publication No. 11-205023

SUMMARY OF THE INVENTION

The above-mentioned Patent Document 1 describes a structure in which a single antenna system for receiving the AM broadcast waves and the FM broadcast waves is formed in the blank space of the rear window glass of the automobile, and in which the amplifier for amplifying the reception sensitivity of the glass antenna is attached to a feed terminal of the antenna.

However, in such a case that the AM antenna and the FM antenna are formed into the single antenna, it is necessary to conduct a tuning for satisfying both frequency bands of the AM band and the FM band. Therefore, there has been a problem in which the tuning operation becomes complicated to increase man-hour remarkably, and a problem in which the high reception sensitivity is not obtained when the FM broadcast radio waves are received since the single antenna receives the both bands of the AM broadcast radio wave and the FM broadcast radio wave.

On the other hand, in the patent document 2, there are provided the antennas for two broadcast bands of the first antenna for the high band and the second antenna for the low band which are located above the defogger of the rear window glass of the automobile. The first antenna and the second antenna are capacitive-coupled. The different resonances are used by the respective antennas to improve the sensitivities of the two frequency bands. It is possible to independently tune the both frequency bands of the AM rand band and the FM radio band. Therefore, it is possible to simplify the tuning operation. However, when the glass antenna according to the present invention is mass-produced, there is a problem that it is not necessarily possible to obtain the satisfactory reception characteristic by the variation of the element of each circuit.

The present invention provides an antenna that receives an AM broadcast wave and an FM broadcast wave, that is formed on a blank space of defogging heater strips of a rear window glass of an automobile, that solves the above-mentioned problems, and particularly that makes the reception gain of the FM radio broadcast waves and the directional characteristic high.

That is, the present invention is a vehicular glass antenna which is provided in an upper blank space of defogging heater strips of a rear window glass of the vehicle, the vehicular glass antenna comprising: an AM broadcast wave receiving antenna including; a plurality of horizontal strips arranged at intervals, at least two vertical strips which are orthogonal to the horizontal strips, and which are apart from each other, and an AM feed point located between the vertical strips, on uppermost one of the horizontal strips or through an extension line extending from a portion of the uppermost one of the horizontal strips, and two FM broadcast wave receiving antennas extending, respectively, from two FM feed points provided above the uppermost one of the horizontal strips of the AM broadcast wave receiving antenna on left and right sides of the AM feed point, along a part of an outermost portion of the AM broadcast wave receiving antenna, the FM broadcast wave receiving antennas extending, respectively, in opposite directions of a clockwise direction and a counter-clockwise direction, one of the FM broadcast wave receiving antennas which has a substantially U-shape, and which surrounds all of ends of the plurality of the horizontal strips of the AM broadcast wave receiving antenna on one side, the other of the FM broadcast wave receiving antennas which has a substantially U-shape, and which surrounds a part of ends of the plurality of the horizontal strips on the other side, and each of the two FM broadcast wave receiving antennas including a second horizontal strip which is adjacent to the horizontal strips of the AM broadcast wave receiving antenna to achieve the capacitive coupling.

Alternatively, the present invention is a vehicular glass antenna which is provided in an upper blank space of defogging heater strips of a rear window glass of the vehicle, the vehicular glass antenna comprising: an AM broadcast wave receiving antenna including; a plurality of horizontal strips arranged at intervals, at least two vertical strips which are orthogonal to the horizontal strips, and which are apart from each other, and an AM feed point located between the vertical strips, on uppermost one of the horizontal strips or through an extension line extending from a portion of the uppermost one of the horizontal strips, and two FM broadcast wave receiving antennas extending, respectively, from two FM feed points provided above the uppermost one of the horizontal strips of the AM broadcast wave receiving antenna on left and right sides of the AM feed point, along a part of an outermost portion of the AM broadcast wave receiving antenna, the FM broadcast wave receiving antennas extending, respectively, in opposite directions of a clockwise direction and a counter-clockwise direction, the pair of the left and right FM broadcast wave receiving antennas including a pair of left and right second vertical strips which have different lengths, the second vertical strips sandwiching and surrounding portions near both ends of the horizontal strips of the AM broadcast wave receiving antenna on outermost sides, the pair of the left and right FM broadcast wave receiving antennas being adjacent to the horizontal strips of the AM broadcast wave receiving antenna to achieve the capacitive coupling.

Alternatively, the present invention is a vehicular glass antenna wherein second horizontal strips of the FM broadcast wave receiving antennas which extend, respectively, from the two FM feed points horizontally in opposite directions are adjacent to the horizontal strips of the AM broadcast wave receiving antenna to achieve the capacitive coupling; each of the FM broadcast wave receiving antennas includes at least a second vertical strip extending from an end of one of the second horizontal strips in a substantially vertical direction or in an arc shape along outsides of the plurality of the horizontal strips of the AM broadcast wave receiving antenna; and each of the FM broadcast wave receiving antennas has a U-shape.

Alternatively, the present invention is a vehicular glass antenna wherein a distance between centers of terminals of the two FM broadcast feed points is equal to or greater than 100 mm, and equal to or smaller than 400 mm.

Alternatively, the present invention is a vehicular glass antenna wherein a distance between a center of the AM feed point and a center of the FM broadcast feed point is equal to or greater than 50 mm, and equal to or smaller than 350 mm.

Alternatively, the present invention is a vehicular glass antenna wherein there is provided one or a plurality of folded horizontal strips which is formed by folding an end of the FM broadcast wave receiving antenna, and which is adjacent to the horizontal strips for receiving the AM broadcast wave to achieve the capacitive coupling.

Alternatively, the present invention is a vehicular glass antenna wherein the FM broadcast wave receiving antenna has a loop shape.

Alternatively, the present invention is a vehicular glass antenna wherein the loop shape of the FM broadcast wave receiving antenna is located in a position above the AM broadcast wave receiving antenna or in a position below the AM broadcast wave receiving antenna, or both in the positions above and below the AM broadcast wave receiving antenna.

Alternatively, the present invention is a vehicular glass antenna wherein the FM broadcast wave receiving antennas of the two systems are arranged to achieve a diversity reception or phase diversity reception.

Alternatively, the present invention is a vehicular glass antenna wherein the horizontal strip of the AM broadcast wave receiving antenna is adjacent to a horizontal strip of the defogging heater strips to achieve the capacitive coupling.

Alternatively, the present invention is a vehicular glass antenna wherein an auxiliary vertical strip extending in the upward direction from an upper end of the bus bar of the defogging heater strips is adjacent to and along an outside of the second vertical strip of the FM broadcast wave receiving antenna to achieve the capacitive coupling.

Alternatively, the present invention is a vehicular glass antenna wherein the vehicular glass antenna comprises at least a horizontal auxiliary strip which branches from a substantially middle portion of a lowermost one of the heater strips of the defogging heater strips, and which extends in one of left and right directions of the horizontal direction, or in both of the left and right directions.

Alternatively, the present invention is a vehicular glass antenna wherein the lowermost one of the auxiliary horizontal strips is adjacent to an opening portion of a body flange to achieve the capacitive coupling.

Alternatively, the present invention is a vehicular glass antenna wherein the FM broadcast wave receiving antenna from the FM feed point to an end has an entire antenna length of 800-2,500 mm in case of the FM broadcast wave receiving antenna of a frequency of 76-90 MHz for Japanese domestic use, and in case of the FM broadcast wave receiving antenna of a frequency of 88-108 MHz for use outside Japan; a sum of length of each horizontal strip of a portion that the second horizontal strip of the FM broadcast wave receiving antenna and the uppermost one of the horizontal strips of the AM broadcast wave receiving antenna are adjacent to each other to achieve the capacitive coupling is 800 mm-2,500 mm in case of the FM broadcast wave receiving antenna of a frequency of 76-90 MHz for Japanese domestic use, and also in case of the FM broadcast wave receiving antenna of a frequency of 88-108 MHz for use outside Japan; and a distance of the portion that the second horizontal strip of the FM broadcast wave receiving antenna and the uppermost one of the horizontal strips of the AM broadcast wave receiving antenna are adjacent to each other to achieve the capacitive coupling is 2-30 mm in case of the FM broadcast wave receiving antenna of a frequency of 76-90 MHz for Japanese domestic use, and in case of the FM broadcast wave receiving antenna of a frequency of 88-108 MHz for use outside Japan.

Alternatively, the present invention is a vehicular glass antenna wherein the vehicular glass antenna includes at least a vertical strip crossing the plurality of the horizontal strips of the defogging heater strips.

DETAILED DESCRIPTION

Figure 1:
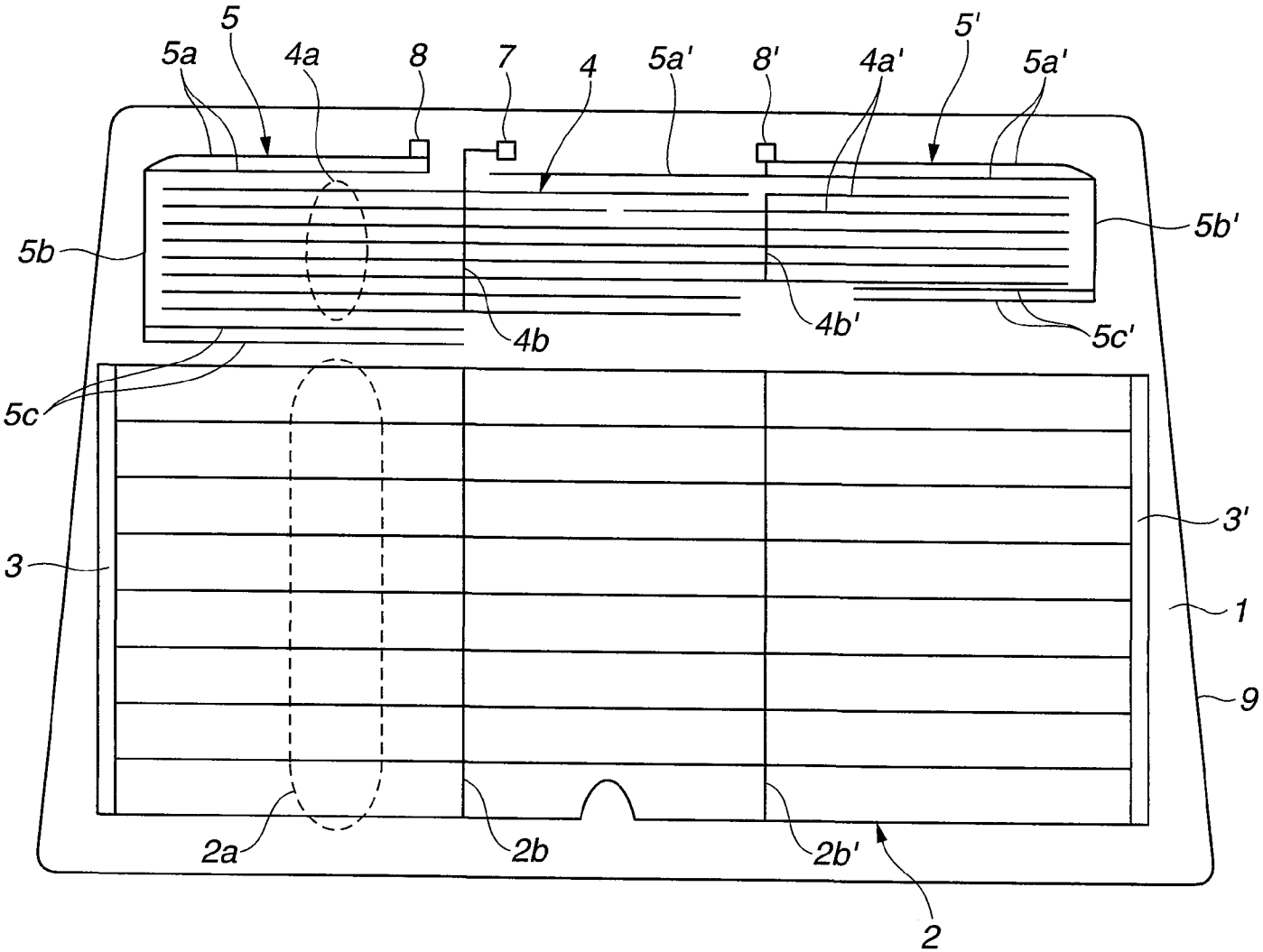
FIG. 1 is a front view showing a glass antenna provided to a rear window glass for a vehicle, according to a first embodiment of the present invention.

By the present invention, there were separately provided the AM broadcast wave receiving antenna provided in a space above the defogging heater strips (defogger) of the rear window glass of the vehicle, and a pair of left and right FM broadcast wave receiving antennas provided on the both sides of the AM broadcast wave receiving antenna. With this, it was possible to decrease the time and the man-hour necessary for the tuning of the antennas.

Moreover, the AM broadcast wave receiving antenna was provided to be surrounded by the pair of the left and right FM broadcast wave receiving antennas which were disposed on the both sides of the AM broadcast wave receiving antenna, and which included, respectively, vertical strips having different lengths. The second horizontal strip of the FM broadcast wave receiving antenna was adjacent to the uppermost one of the horizontal strips of the AM broadcast wave receiving antenna to achieve the capacitive coupling. Moreover, the folded horizontal strip was adjacent to a part of the lowermost one of the horizontal strips of the AM broadcast wave receiving antenna or one of the horizontal strips of the AM broadcast wave receiving antenna near the lowermost one of the horizontal strips of the AM broadcast wave receiving antenna to achieve the capacitive coupling. With this, it was possible to considerably improve the reception sensitivity of the FM broadcast wave receiving antenna.

Moreover, in the FM broadcast wave receiving antenna, the pair of the left and right second vertical strips which have different lengths extended on the both sides of the AM broadcast wave receiving antenna. This is effective to achieve the diversity reception and the phase diversity reception.

Moreover, the uppermost one of the defogging heater strips (the defogger) was adjacent to the lowermost one of the horizontal strips of the AM broadcast wave receiving antenna to achieve the capacitive coupling. With this, it is possible to pick up the AM broadcast wave received by the defogging heater strips (the defogger), and to improve the reception characteristics relative to a case in which only the AM broadcast wave receiving antenna 4 receives the radio wave.

Moreover, the folded strips 5*c*, 5*c*' located at the lowermost portion of the main antenna 5 and the sub antenna 5' for receiving the FM broadcast wave were adjacent to the uppermost one of the horizontal strips of the defogging heater strips (defogger) to achieve the capacitive coupling. With this, it is possible to pick up the FM broadcast wave received by the defogging heater strips (the defogger), and to improve the reception characteristics relative to a case in which only the main antenna 5 or the sub antenna 5' for receiving the FM broadcast wave receives the radio wave.

In this way, there were separately provided two antenna systems of the AM broadcast wave receiving antenna 4 and the FM broadcast wave receiving antennas 5, 5'. With this, it became possible to effectively perform the tuning by separately tuning the AM broadcast wave receiving antenna and the FM broadcast wave receiving antenna, to facilitate the tuning operation, and to decrease the man-hour of the tuning operation.

In the present invention, the two antennas of the AM broadcast wave receiving antenna 4 and the FM broadcast wave receiving antenna 5 are provided in a blank space above the defogging heater strips 2 of the rear window glass 1 of the vehicle. The AM broadcast wave receiving antenna 4 is provided near the FM broadcast wave receiving antenna 5. The AM broadcast wave receiving antenna 4 has a system different from the FM broadcast wave receiving antenna 5. The defogging heater strips 2 (called defogger) includes a plurality of substantially horizontal heater strips 2*a* which are disposed in a central region of the rear window glass of the vehicle, and which are in parallel to each other. Ends of the heater strips 2*a* are connected by conductive bus bars 3, 3'. The defogging heater strips 2 are heated by being applied with the current, and arranged to evaporate the moisture on the surface of the window glass, and thereby to defog.

As shown in FIGS. 1-4, the AM broadcast wave receiving antenna 4 includes a plurality of horizontal strips arranged at intervals; and at least tow vertical strips which are separated from each other. An AM feed point 7 is provided at a position between the at least two vertical strips, and on the uppermost one of the horizontal strips or on an extension line from a portion of the uppermost one of the horizontal strips.

In the at least two vertical strips of the AM broadcast wave receiving antenna 4, at least one of the at least two vertical strips extends from the uppermost one of the horizontal strips. The other of the at least two vertical strips extends from the uppermost one of the horizontal strips to be orthogonal to all or part of the horizontal strips.

The vertical strips 4*b*, 4*b*' were connected and crossed with the plurality of the horizontal strips 4*a*, 4*a*, . . . , and located near positions to divide substantially equally the plurality of the horizontal strips 4*a*, 4*a*, . . . into three sections. However, the horizontal strips 4*a*, 4*a*, . . . may not have the identical length to be deviated from each other in the leftward and rightward directions. Moreover, the length of one of the left and right may be slightly short. Accordingly, it is not necessary to be bilaterally symmetrical.

The positions to divide substantially equally the plurality of the horizontal strips 4*a*, 4*a*, . . . into three sections are near positions to divide substantially equally the maximum width of the horizontal strips 4*a*, 4*a*, . . . into three sections. The positions of the vertical strips 4*b*, 4*b*' are not limited to these positions. The vertical strips 4*b*, 4*b*' may be further apart from each other in the leftward and rightward directions to positions which divide substantially equally the plurality of the horizontal strips 4*a*, 4*a*, . . . into four sections, and which are on the leftmost and rightmost positions.

It is preferable that the lowermost one of the horizontal strips 4*a* of the AM broadcast wave receiving antenna 4 or one of the horizontal strips 4*a*' connected with the lower end of one of the vertical strips is adjacent to the uppermost one of the horizontal strips 2*a* of the defogging heater strips 2 to achieve the capacitive coupling. In this case, it is possible to pick up the AM radio broadcast radio wave received by defogger 2.

The FM broadcast wave receiving antenna 5, 5' extended from the two FM feed points 8, 8' provided above the uppermost one of the horizontal strips 4*a* of the AM broadcast wave receiving antenna 4 on the left and right sides of the AM feed point 7, along a part of the outermost portion of the AM broadcast wave receiving antenna 4. The pair of the FM broadcast wave receiving antennas 5, 5' extended, respectively, in opposite directions of the clockwise direction and the counterclockwise direction. The pair of the left and right FM broadcast wave receiving antenna 5, 5' sandwiched and surrounded the AM broadcast wave receiving antenna 4. The FM broadcast wave receiving antenna 5, 5' were adjacent to at least a part of the horizontal strips 4*a* of the AM broadcast wave receiving antenna 4 to achieve the capacitive coupling.

The plurality of the horizontal strips 4*a*, 4*a*, . . . may not have the identical length. The numbers of the horizontal strips at the both left and right ends of the AM broadcast wave receiving antenna 4 are different from each other. Therefore, the lengths of the left and right second vertical strips 5*b*, 5*b*' of the pair of the left and right FM broadcast wave receiving antennas 5, 5' to surround all of the both side end portions of the AM broadcast wave receiving antenna 4 are different from each other. This is preferable to achieve the diversity reception and the phase diversity reception.

The second horizontal strips 5*a*, 5*a*' extending from the FM feed points 8, 8' of the FM broadcast wave receiving antennas 5, 5' are adjacent to the uppermost one of the horizontal strips 4*a* of the AM broadcast wave receiving antenna 4. Moreover, the second vertical strip 5*b* extends in the substantially vertical direction or in the arc shape from the end of the second horizontal strip 5*a* along the end of the second horizontal strip 5*a* along the contour of the outside of the plurality of the horizontal strips 4*a*, 4*a*, . . . of the AM broadcast wave receiving antenna 4. The folded horizontal strips 5*c*, 5*c*' folded in the U-shape from the end of the second vertical strip 5*b* are adjacent to the lower portion of the lowermost one of the horizontal strips 4*a* of the AM broadcast wave receiving antenna 4. The above-mentioned configuration is preferable. However, it is optional that the FM broadcast wave receiving antenna 5, 5' are adjacent to the horizontal strips 4*a*, 4*a*, . . . between the uppermost one and the lowermost one of the horizontal strips 4*a*, 4*a*, . . . at positions of the both end portions of the AM broadcast wave receiving antenna 4 so as to achieve the capacitive coupling.

Moreover, it is optional to provide two second horizontal strips 5*a*, and to connect end portions of the two second horizontal strips 5*a* to form a closed loop.

It is preferable that a distance between centers of terminals of the two FM broadcast feed points 8, 8' is equal to or greater than 100 mm, and equal to or smaller than 400 mm. Moreover, it is preferable that a distance between a center of the AM feed point 7 and a center of one of the FM broadcast feed point 8, 8' is equal to or greater than 50 mm, and equal to or smaller than 350 mm.

That is, when the distance between the center of the AM feed point 7 and the center of the one of the FM broadcast feed points 8 is, for example, 50 mm, it is preferable that the distance between the center of the AM feed point 7 and the center of the other of the FM broadcast feed point 8' is equal to or greater than 50 mm, and equal to or smaller than 350 mm.

This is because it is not possible that the distance between the centers of the two feed points is equal to or smaller than 50 mm since the terminal itself has a width. Moreover, when the two feed points are too close to each other, the two feed points may adversely affect each other. On the other hand, when the two feed points are too away from each other, it is inconvenience for the wiring.

The number of the folded horizontal strip 5*c* formed by folding the end of the FM broadcast wave receiving antenna 5 is one or two. The part of the one or two folded horizontal strip(s) 5*c* is adjacent to a part of the ends of the horizontal strips 4*a*, 4*a*, . . . of the AM broadcast wave receiving antenna 4 to achieve the capacitive coupling. Moreover, as shown in FIGS. 2 and 3, it is possible to connect the both ends of the two folded strips to form the closed loop.

Figure 2:
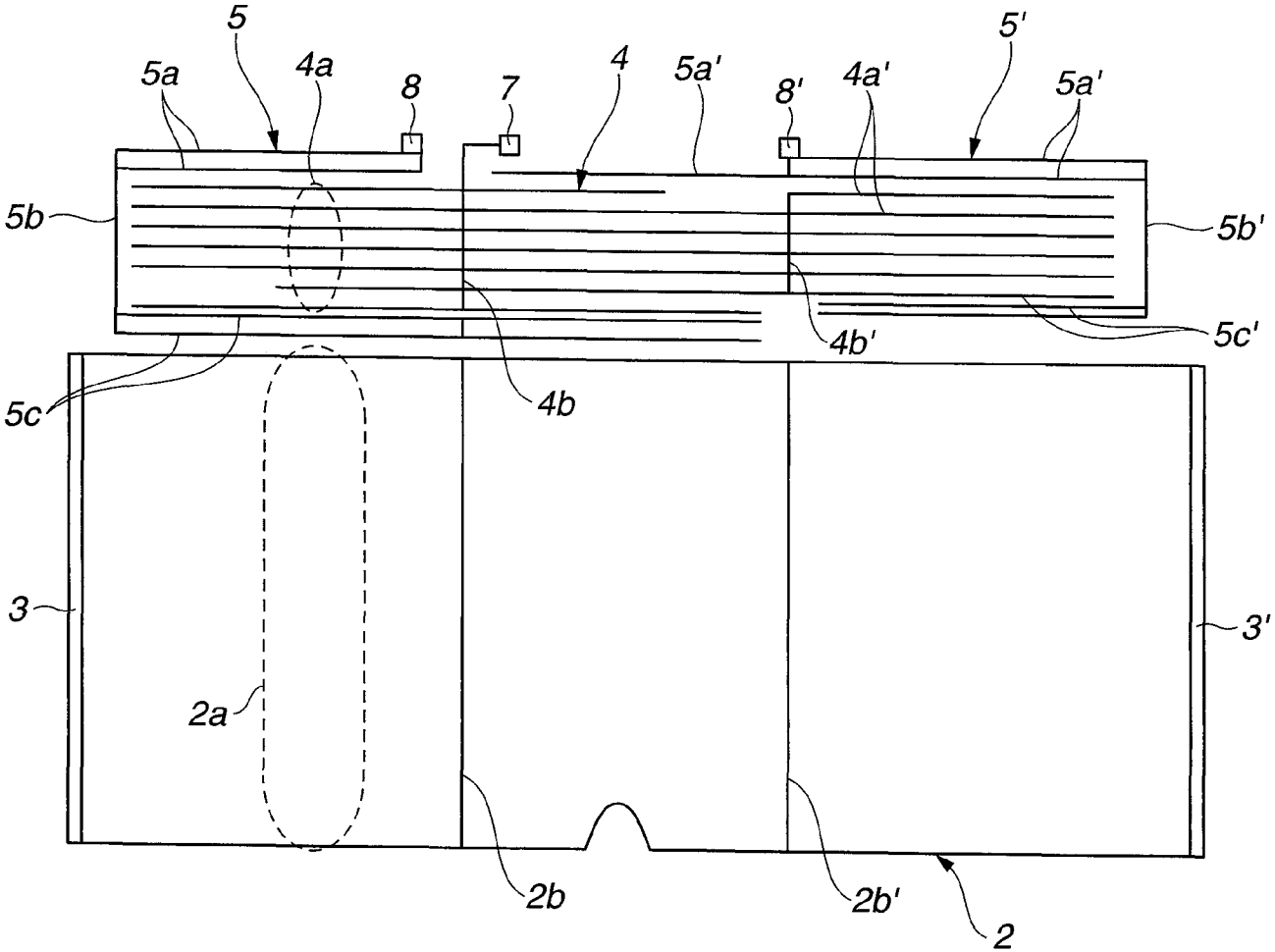
FIG. 2 is a front view showing a glass antenna provided to a rear window glass for a vehicle, according to a second embodiment of the present invention.
Figure 3:
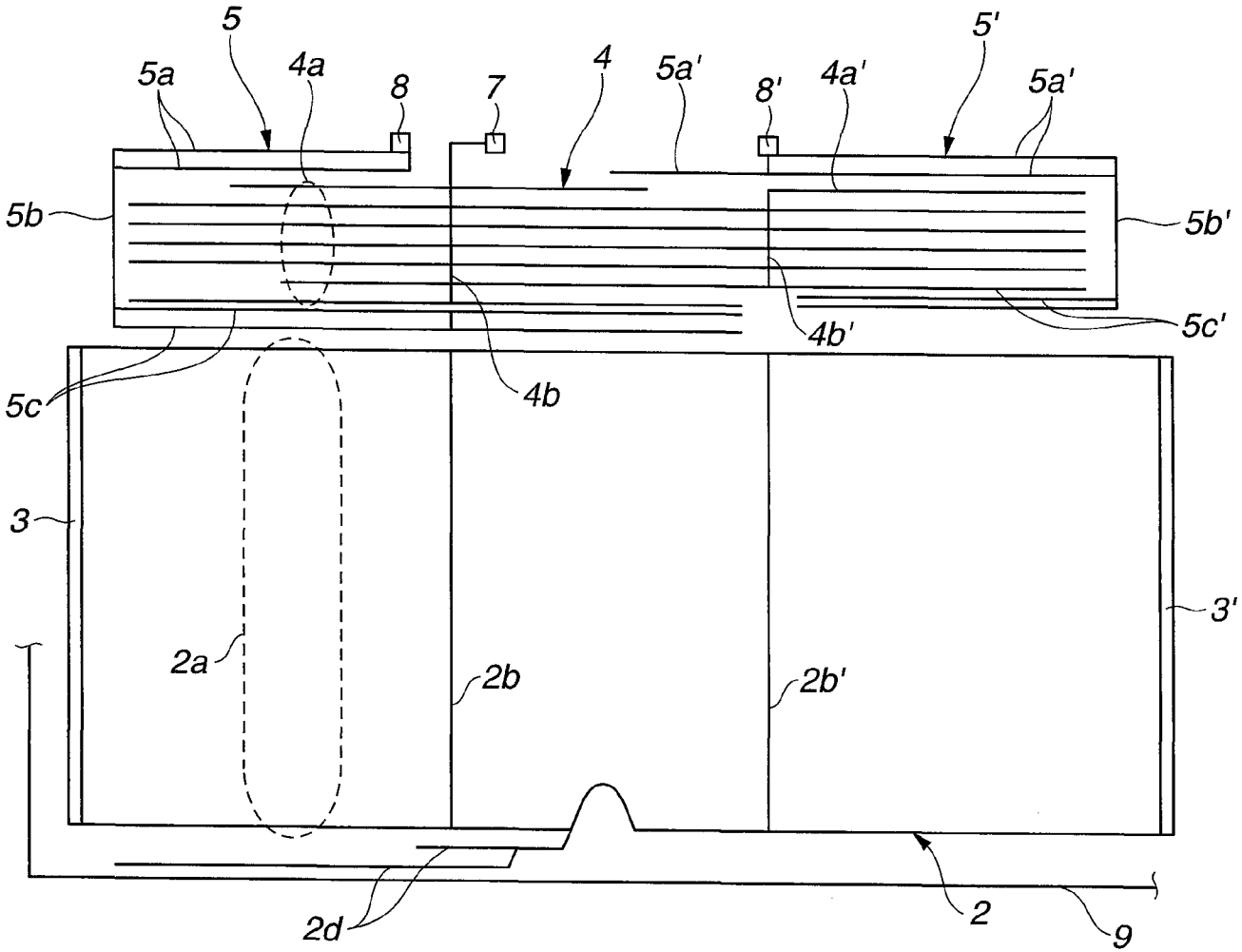
FIG. 3 is a front view showing a glass antenna provided to a rear window glass for a vehicle, according to a third embodiment of the present invention.

As shown in FIGS. 1-4 and FIGS. 7-10, each of the FM broadcast wave receiving antenna 5, 5' includes the strip with the closed loop shape provided at a position above the AM broadcast wave receiving antenna 4, or at a position below the AM broadcast wave receiving antenna 4. However, the closed loop portions may be provided both at the position above the AM broadcast wave receiving antenna 4, and at the position below the AM broadcast wave receiving antenna 4, as shown in FIGS. 2 and 3.

When the two folded horizontal strips 5*c* are provided, it is preferable that the two folded horizontal strips 5*c* sandwich the part of the end of the lowermost one of the horizontal strips 4*a* of the AM broadcast wave receiving antenna 4 or one of the horizontal strips 4*a*, 4*a*, . . . near the lowermost horizontal strip 4*a*. With this, it is possible to effectively pick up the radio wave received by the AM broadcast wave receiving antenna 4 from the adjacent portion.

Figure 4:
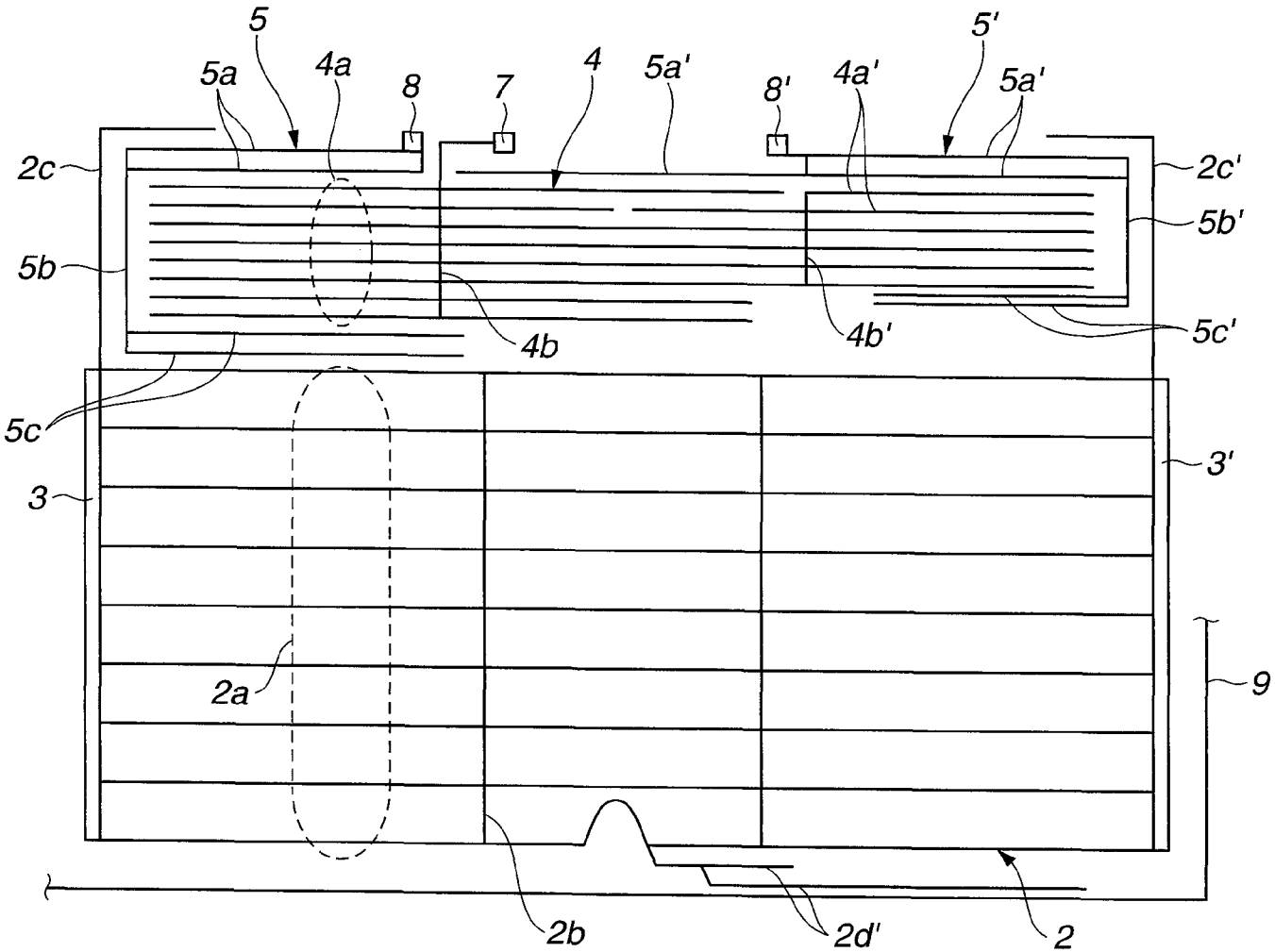
FIG. 4 is a front view showing a glass antenna provided to a rear window glass for a vehicle, according to a fourth embodiment of the present invention.
Figure 10:
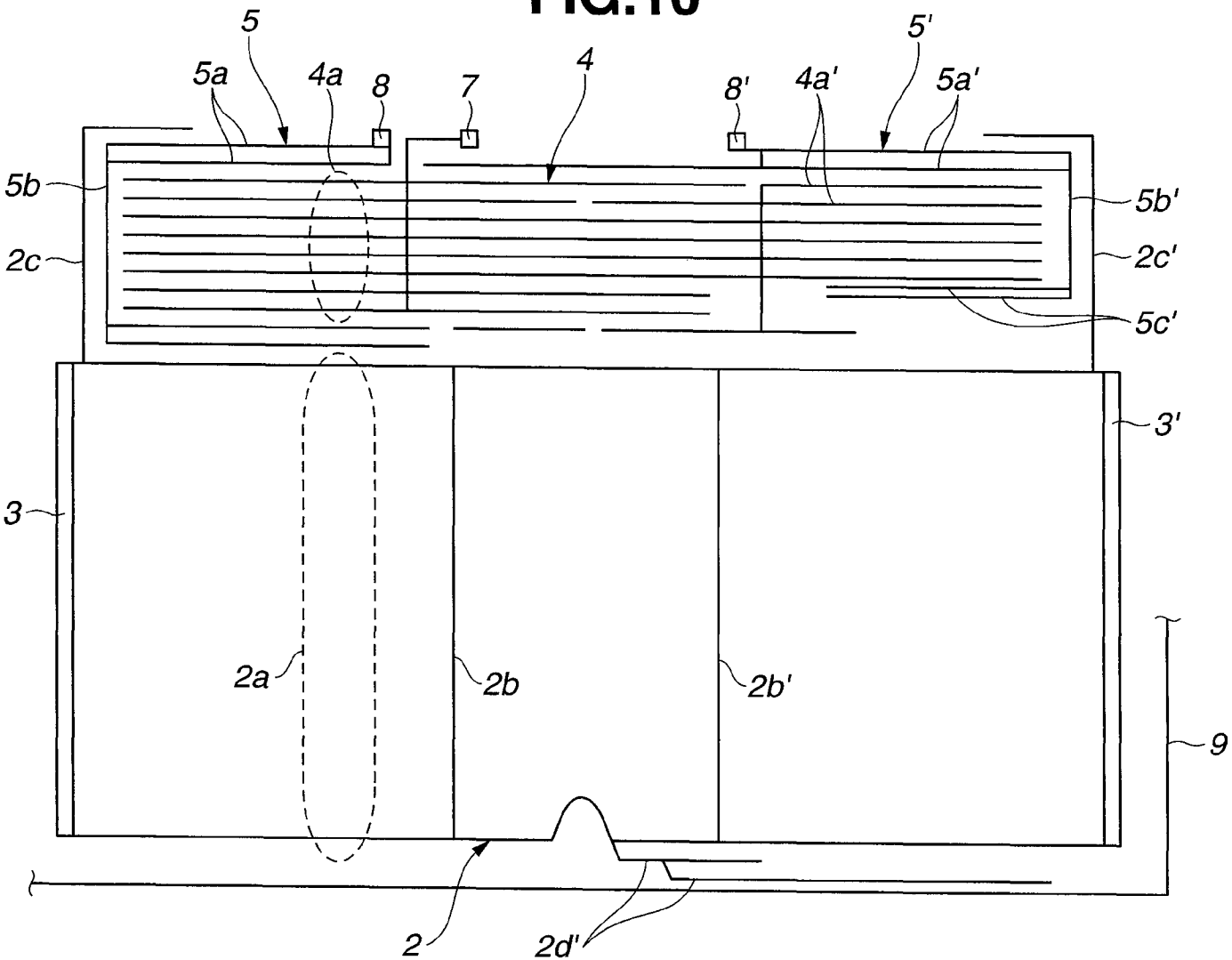
FIG. 10 is a front view showing a glass antenna provided to a rear window glass for a vehicle, according to an eighth embodiment of the present invention.

Moreover, it is desirable that the auxiliary vertical strips 2*c*, 2*c*' extending in the upward direction from the upper ends of the bus bars 3, 3' of the defogging heater strips 2 are adjacent to at least the outside of the second vertical strips 5*b* of the FM broadcast wave receiving antenna 5 to achieve the capacitive coupling, as shown in FIGS. 4 and 10. With this, it is possible to pick up the radio wave of the FM radio broadcast received by the defogging heater strips 2 through the auxiliary vertical strips 2*c*, 2*c*'.

There were provided two separate systems of the FM broadcast wave receiving antenna 5 and the FM broadcast wave receiving antenna 5' which extend, respectively, in the counterclockwise direction and in the clockwise direction on the outermost portions of the AM broadcast wave receiving antenna 4 from the two FM feed points 8 provided on both sides of the AM feed point 7 of the AM broadcast wave receiving antenna 4 to sandwich the AM feed point 7. The FM broadcast wave receiving antenna 5 and the FM broadcast wave receiving antenna 5' were arranged to achieve the diversity reception or the phase diversity reception.

The lengths of the strips of the FM broadcast wave receiving antennas 5, 5' extending from the FM feed points 8, 8' to ends were 800-2,500 mm for the frequency of 76-90 MHz for Japanese domestic use and for the frequency of 88-108 MHz for use outside Japan.

In one of the vehicular glass antennas described above, the sum of the lengths of the horizontal strips that the second horizontal strips 5*a*, 5*a*' of the FM broadcast wave receiving antenna and the uppermost one of the AM broadcast wave receiving antenna are adjacent to achieve the capacitive coupling, and the sum of the length of each horizontal strip of a portion that the folded horizontal strips 5*c*, 5*c*' and the lowermost one of the horizontal strips of the AM broadcast wave receiving antenna are adjacent to achieve the capacitive coupling are, respectively, 800-2,500 mm for the frequency of 76-90 MHz for Japanese domestic use and for the frequency of 88-108 MHz for use outside Japan. Moreover, the distance between the strips that the second horizontal strips 5*a*, 5*a*' of the FM broadcast wave receiving antenna and the uppermost one of the AM broadcast wave receiving antenna are adjacent to achieve the capacitive coupling, and the distance between the strips that the horizontal strips that the folded horizontal strips 5*c*, 5*c*' and the lowermost one of the horizontal strips of the AM broadcast wave receiving antenna are adjacent to achieve the capacitive coupling are, respectively, 2-30 mm for the frequency of 76-90 MHz for Japanese domestic use and for the frequency of 88-108 MHz for use outside Japan.

It is possible to obtain the satisfactory reception characteristics only by the one of the FM broadcast wave receiving antennas 5, 5'. However, it is preferable that one of the FM broadcast wave receiving antennas 5, 57 is used as the main antenna, and that the other of the FM broadcast wave receiving antennas 5, 5' is used as the sub antenna to achieve the diversity reception or the phase diversity reception to input to the tuner (not shown). In this case, it is possible to improve the directional characteristics relative to a case in which the radio wave is received only by one of the FM broadcast wave receiving antennas 5, 5' to input to the tuner (not shown).

The defogging heater strips 2 are provided in a central region of the rear window glass 1. The defogging heater strips 2 include a plurality of substantially parallel heater strips 2*a* arranged substantially in parallel with each other. Both ends of the heater strips 2*a* are connected by the conductive bus bars 3, 3'. The defogging heater strips 2 are heated by a direct-current power supply (not shown).

The vertical strips 2*b* connecting the points to divide substantially equally the plurality of the horizontal strips 2*a* of the defogging heater strips 2 into the three sections are not energized to have a neutral electric potential. The vertical strips 2*b* are not the defogging heater strips. The vertical strips 2*b* are effective to make the defogging heater strips 2 operate as the antenna, and to improve the reception gain of the radio wave of the AM/FM broadcast wave by using the radio wave received by the defogging heater strips 2. However, the vertical strips may not be necessarily provided.

There are provided one or two auxiliary horizontal strip(s) 2*d*, 2*d*' which branches from a substantially middle portion of the lowermost one of the heater strips of the defogging heater strips 2, and which extends in one of leftward and rightward directions or in both directions. With this, it is possible to improve the directional characteristics of the antennas by providing the auxiliary horizontal strips 2*d*, 2*d*'. It is preferable that there are provided two upper and lower auxiliary horizontal strips 2*d*, 2*d*. With this, the upper auxiliary horizontal strip 2*d*, 2*d*' adjusts the impedance. The lower auxiliary horizontal strip 2*d*, 2*d*' is adjacent to the flange flame 9 for the rear window of the metal body. With this, it is possible to pick up the radio wave of the AM broadcast wave and the radio wave of the FM broadcast wave which are received by the body.

The auxiliary vertical strips 2*c*, 2*c*' shown in FIGS. 4 and 10 which extend in the upward direction from the upper ends of the two bus bars 3, 3' of the defogging heater strips 2 may not be necessarily provided. The auxiliary vertical strips 2*c*, 2*c*' are adjacent to and along the outsides of the vertical strips 5*b*, 5*b*' of the FM broadcast wave receiving antennas 5, 5' and the upper sides of the second horizontal strips 5*a*, 5*a*' to achieve the capacitive coupling. With this, the FM broadcast wave receiving antennas 5, 5' can pick up the radio wave of the FM radio broadcast wave received by the defogging heater strips 2 through the auxiliary vertical strips 2*c*, 2*c*'. Therefore, it is possible to effectively achieve the broader bandwidth of the frequency characteristics, and to effectively improve the reception sensitivity.

It is possible to obtain a good reception sensitivity by the FM broadcast wave receiving antenna 5, 5' according to the present invention, without connecting an amplifier or an impedance matching circuit between the FM feed point of the FM broadcast wave receiving antenna 5, 5' and the tuner. However, it is possible to further improve the reception sensitivity by connecting an amplifier or impedance matching circuit.

In the following, operation of the present invention is described.

In the present invention, there were formed separate antennas of the AM broadcast wave receiving antenna 4 and the FM broadcast wave receiving antenna 5. Therefore, they can be tuned to have strip lengths suitable for respective reception frequencies. The tuning operation is easy.

The FM broadcast wave receiving antennas extended, respectively, from the two FM feed points provided above the uppermost one of the horizontal strips of the AM broadcast wave receiving antenna on the left and right sides of the AM feed point, along the outermost portion of the AM broadcast wave receiving antenna. The FM broadcast wave receiving antennas extended, respectively, in opposite directions of the clockwise direction and the counterclockwise direction. The pair of the left and right FM broadcast wave receiving antennas sandwiched and surrounded the both left and right ends of the plurality of the horizontal strips of the AM broadcast wave receiving antenna. The pair of the left and right FM broadcast wave receiving antennas were adjacent to the horizontal strips of the AM broadcast wave receiving antenna to achieve the capacitive coupling.

That is, the pair of the left and right FM broadcast wave receiving antennas 5, 5' sandwich and surround the outermost ends of the plurality of the horizontal strips of the AM broadcast wave receiving antenna 4. The second horizontal strips 5*a*, 5*a*' of the FM broadcast wave receiving antennas 5, 5' are adjacent to the uppermost one of the horizontal strips 4*a* of the AM broadcast wave receiving antenna 4 to achieve the capacitive coupling. The folded horizontal strips 5*c*, 5*c*' are adjacent to the outside of the lowermost one of the horizontal strips 4*a* of the AM broadcast wave receiving antenna 4, that is, the lower side of the lowermost one of the horizontal strips 4*a* of the AM broadcast wave receiving antenna 4 to achieve the capacitive coupling. With this, it is possible to achieve surer capacitive coupling. The FM broadcast wave receiving antennas 5, 5' can pick up the radio wave of the FM broadcast wave band which is received by the AM broadcast wave antenna 4. Therefore, it is possible to improve the reception sensitivity of the FM broadcast wave receiving antennas 5, 5', and to obtain stable performance.

As shown in FIGS. 4 and 10, the auxiliary vertical strips 2*c*, 2*c*' extended in the upward direction from the upper ends of the bus bars 3, 3' of the heating conductive strip 2. The auxiliary vertical strips 2*c*, 2*c*' were adjacent to at least the outsides of the second vertical strips 5*b*, 5*b*' of the FM broadcast wave receiving antenna 5 to achieve the capacitive coupling. With this, it is possible to pick up the radio wave of the FM radio broadcast wave received by the defogging heater strips 2 through the auxiliary vertical strips 2*c*, 2*c*', and to improve the reception gain.

One of the two FM broadcast wave receiving antennas was used as the main antenna 5, and the other of the two FM broadcast wave receiving antennas was used as the sub antenna 5'. However, either of the FM broadcast wave receiving antennas may be used as the main antenna.

In a case in which the FM broadcast wave receiving sub antenna 5' is disposed in the blank space above the defogging heater strips 2, it is possible to obtain the antenna sensitivity substantially identical to the antenna sensitivity of the FM broadcast wave receiving main antenna 5, to thereby achieve the diversity reception or the phase diversity reception by the main antenna 5 and the sub antenna 5', and thereby to complement each other's low reception characteristics and low directional characteristics.

Figure 7:
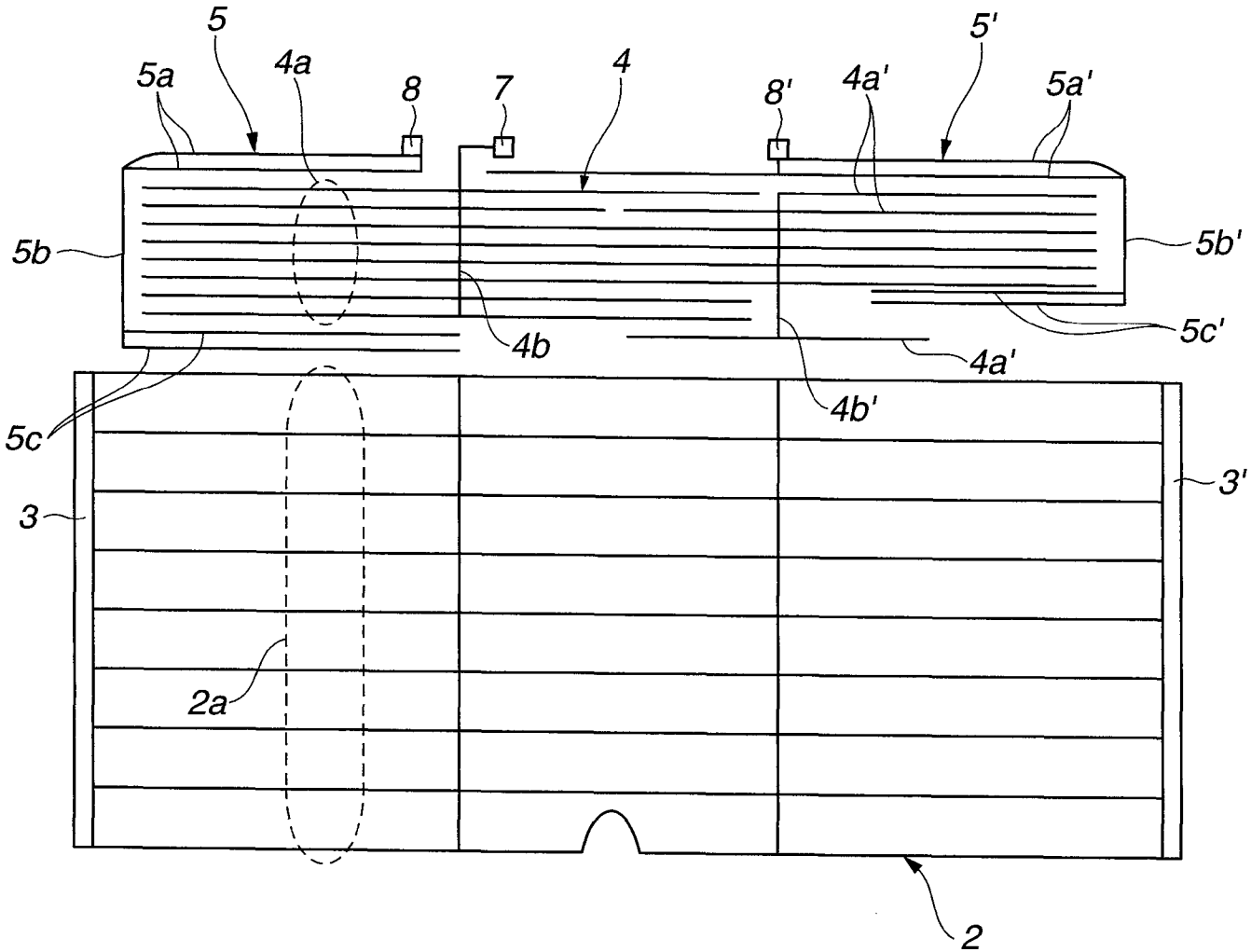
FIG. 7 is a front view showing a glass antenna provided to a rear window glass for a vehicle, according to a fifth embodiment of the present invention.

The plurality of the horizontal heater strips 2*a*, 2*a*, . . . as shown in FIGS. 1 and 7 are omitted in the drawings of the defogging heater strips of FIGS. 2, 3 and 8-10. It is considered that there are the plurality of the heater strips 2*a*, like the defogging heater strips of FIGS. 1 and 7.

Hereinafter, the present invention is illustrated with reference to the drawings.

First Embodiment

As shown in FIG. 1, in the upper space of the defogging heater strips 2 of the automotive rear window glass, there were provided the AM broadcast wave receiving antenna 4 and main and sub FM broadcast wave receiving antenna 5, 5' of a frequency of 76 MHz-90 MHz for Japanese domestic use.

The AM broadcast wave receiving antenna 4 included eight horizontal strips 4*a*, 4*a* . . . which are arranged at intervals; and two vertical strips 4*b*, 4*b*' which are orthogonal to the horizontal strips 4*a*, 4*a* . . . . The two vertical strips 4*b*, 4*b*' were provided at positions to divide substantially equally the horizontal strips 4*a* into three sections. One of the two vertical strips 4*b* was orthogonal to the eight horizontal strips 4*a*, 4*a* . . . from the uppermost horizontal strip to the lowermost horizontal strip. The other of the two vertical strips 4*b*' was orthogonal to the horizontal strips 4*a*, 4*a* . . . from the third horizontal strip from the top to the sixth horizontal strip from the top. Moreover, the AM broadcast wave receiving antenna 4 included other horizontal strips 4*a*', 4*a*' which are different from the horizontal strips 4*a*, 4*a* . . . , and which extends from the end and the middle portion of the vertical strip extending in the upward direction from the upper end of the vertical strip 4*b*'. Moreover, the other of the two vertical strips 4*b* was connected through an extension line with the AM feed point 7 provided above the AM broadcast wave receiving antenna 4.

In the plurality of the horizontal strips 4*a*, 4*a* . . . , the lengths of the first horizontal strip and the second horizontal strip from the top, and the lengths of the first horizontal strip and the second horizontal strip from the bottom have the length shorter than the lengths of the horizontal strips 4*a*, 4*a* . . . in the middle portion. In the vacant area formed by shortening the lengths of these horizontal strips, there are provided the other horizontal strips 4*a*', 4*a*' connected with the vertical strip 4*b*'.

On the other hand, the FM broadcast wave receiving main antenna 5 is a U-shaped antenna strip. The main FM broadcast wave receiving antenna 5 includes second horizontal strips 5*a*, 5*a*, a second vertical strip 5*b* and two folded horizontal strips 5*c*, 5*c*. The second horizontal strips 5*a*, 5*a* extend in the counterclockwise direction from an FM feed point 8 provided near an upper end of the vertical strip 4*b* of the AM broadcast wave receiving antenna 4 and the AM feed point 7, along the uppermost one of the horizontal strips 4*a* of the AM broadcast wave receiving antenna 4. The horizontal strips 5*a*, 5*a* are adjacent to the uppermost one of the horizontal strips 4*a* to achieve the capacitive coupling. The second vertical strip 5*b* extends in the substantially vertical direction to surround ends of all the horizontal strips 4*a*, 4*a* . . . of the AM broadcast wave receiving antenna 4 which extend to the outermost ends. The two folded horizontal strips 5*c*, 5*c* are folded from the end of the second vertical strip 5*b*. The folded horizontal strips 5*c*, 5*c* are adjacent to the lowermost horizontal strip 4*a* in the lower position to achieve the capacitive coupling. The ends of the two second horizontal strips 5*a*, 5*a* are connected to form a closed loop.

The sub FM broadcast wave receiving antenna 5' is a substantially U-shaped antenna strip. The sub FM broadcast wave receiving antenna 5' includes second horizontal strips 5*a*', 5*a*', a second vertical strip 5*b*' and two folded horizontal strips 5*c*', 5*c*'. The second horizontal strips 5*a*', 5*a*' extend in the clockwise direction from the FM feed point 8' provided near the upper end of the vertical strip 4*b*' of the AM broadcast wave receiving antenna 4, along the uppermost one of the horizontal strips 4*a*' of the AM broadcast wave receiving antenna 4. The second horizontal strips 5*a*', 5*a*' are adjacent to the uppermost one of the horizontal strips 4*a*' to achieve the capacitive coupling. The second vertical strip 5*b*' extends in the substantially vertical direction to surround the most right side ends of the second horizontal strips 4*a*', 4*a*' . . . , 4*a*, 4*a* . . . . The two folded horizontal strips 5*c*', 5*c*' are folded from the end of the second vertical strip 5*b*'. The two folded horizontal strips 5*c*', 5*c*' are adjacent to the lowermost one of the horizontal strips 4*a* to achieve the capacitive coupling. The ends of the two second horizontal strips 5*a*', 5*a*' are connected to form a closed loop.

The AM broadcast wave receiving antenna 4 was connected from the AM feed point 7 to a tuner (not shown). Likewise, the FM broadcast wave receiving antennas 5, 5' were connected from the FM feed point 8, 8' to a tuner (not shown).

The glass plate 1 has a substantially trapeziform shape. The glass plate 1 has outline dimensions of an upper side of 1,200 mm, a lower side of 1,360 mm, and a height of 500 mm. An inside size of the flange of the widow frame are an upper side of 1,100 mm, a lower side of 1,100 mm and a height of 400 mm.

Moreover, lengths of the strips of the AM broadcast wave receiving antenna 4 according to the present invention are described below.

Lengths of the first and second horizontal strips 4*a* from the above=650 mm, 495 mm Lengths of the third to sixth horizontal strips 4*a* from the above=1,100 mm Lengths of the first and second horizontal strips 4*a* from the below =650 mm, 650 mm Lengths of the first and second horizontal strips 4*a*' from the above=370 mm, 495 mm Distances between the horizontal strips 4*a*=10 mm Lengths of the vertical strips 4*b*, 4*b*'=100 mm, 80 mm Distances between the vertical strips 4*b*, 4*b*'=310 mm Moreover, the length of each strip of the FM broadcast wave receiving antennas 5, 5' according to the present invention is as follows.

Lengths of the second horizontal strips 5*a*, 5*a*'=300 mm, 350 mm

Lengths of the second vertical strips 5*b*, 5*b*'=90 mm, 80 mm

Lengths of the folded horizontal strips 5*c*, 5*c*'=400 mm, 210 mm

Distances between the second horizontal strips 5*a*, 5*a*' of the FM broadcast wave receiving antenna 5, 5' and the uppermost one of the horizontal strips 4*a* of the AM broadcast wave receiving antenna 4, and distances between the folded horizontal strips 5*c*, 5*c*' of the FM broadcast wave receiving antenna 5' and the lowermost one of the horizontal strips 4*a* of the AM broadcast wave receiving antenna 4 were, respectively, 5 mm.

The AM feed point 7 is located at a position which is on the left side from the center line of the glass sheet 1 by 120 mm, and which is substantially on an extension of the vertical strip 4*b* of the AM broadcast wave receiving antenna 4 and the vertical strip 2*b*' of the defogger 2.

On the other hand, the second horizontal strip 5*a* of the FM broadcast wave receiving main antenna 5 was adjacent to the uppermost one of the horizontal strips 4*a* of the AM broadcast wave receiving antenna 4 from the left end by 290 mm. The folded horizontal strip 5*c* was adjacent to the lowermost one of the horizontal strips 4*a* of the AM broadcast wave receiving antenna 4 from the left end by 400 mm.

Moreover, the second horizontal strip 5*a*' of the FM broadcast wave receiving sub antenna 5' was adjacent to the uppermost one of the horizontal strips 4*a*' of the AM broadcast wave receiving antenna 4 from the right end by 345 mm. The folded horizontal strip 5*c*' was adjacent to the lowermost one of the horizontal strips 4*a* of the AM broadcast wave receiving antenna 4 from the right end by 210 mm.

The uppermost one of the horizontal strips 4*a* of the AM broadcast wave receiving antenna 4 was away from the inside of the upper side of the body flange 9 by 30 mm. The lowermost one of the horizontal strips 4*a* was away from the uppermost one of the heater strips 2*a* by 20 mm.

The AM broadcast wave receiving antenna 4, the FM broadcast wave receiving main antenna 5, the FM broadcast wave receiving sub antenna 5', the heating conductive strips 2, the feed points 7, 8 and 8', and the bus bars 3, 3' are formed by printing on the glass sheet by the conductive paste such as silver paste, and then baking.

Thus-obtained window glass sheet was mounted on the rear window of the vehicle. The AM broadcast wave receiving antenna 4 was connected from the AM feed point to the tuner (not shown) by the feeder lines. The FM broadcast wave receiving antennas 5, 5' were connected from the FM feed points 8, 8' to the tuner (not shown) by the feeder lines.

The FM broadcast wave receiving main antenna 5 and the FM broadcast wave receiving sub antenna 5' were arranged to achieve the diversity reception or the phase diversity reception so as to improve the directional characteristics. Accordingly, either of the FM broadcast wave receiving antennas may be a main antenna.

Figure 5:
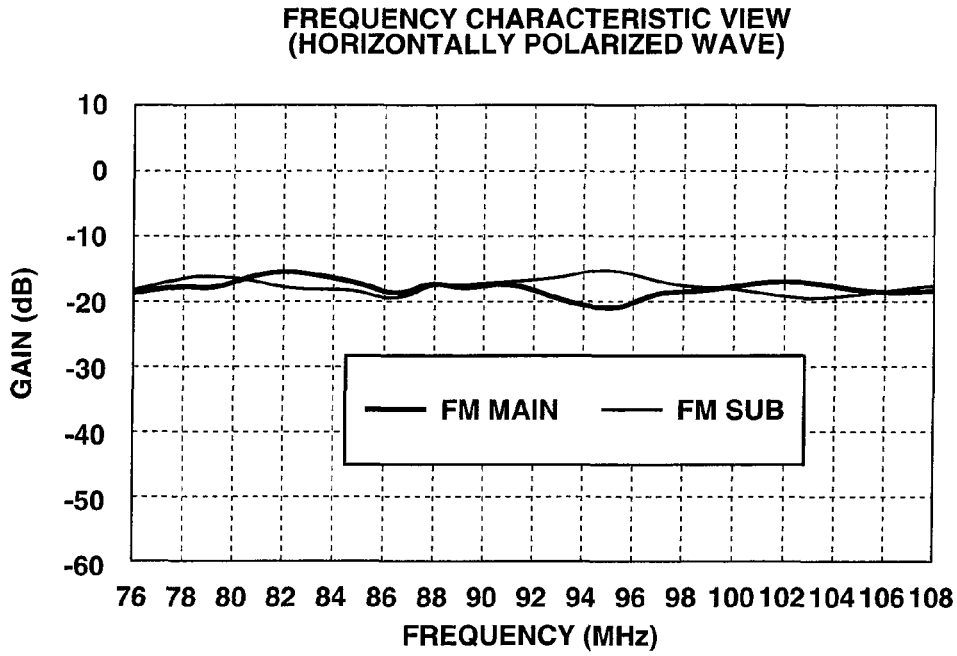
FIG. 5 is a frequency characteristic view of a horizontally polarized wave in the first embodiment of the present invention.

As shown in FIG. 5, in case of receiving, respectively, by the FM main antenna 5 and the FM sub antenna 5', the average reception gains of the horizontally polarized wave of the domestic FM broadcast wave band of 76 MHz-90 MHz became, respectively, −16.2 dBd (dipole antenna ratio). As a result of the diversity reception by the two FM antenna systems of the FM main antenna 5 and the FM sub antenna 5', the average reception gain of the horizontally polarized wave of the domestic FM broadcast wave band of 76 MHz-90 MHz became −13.1 dBd (the dipole antenna ratio). With this, it was found to obtain a very good reception gain relative to the conventional antenna.

Since the AM broadcast waves are amplified by an AM broadcast wave band amplifier in a way similar to the past, it is practically not problematic at all.

As shown in FIG. 1, the horizontal strip of the AM broadcast wave receiving antenna was adjacent to the second horizontal strip of the FM broadcast wave receiving antenna to achieve the capacitive coupling. With this, the reception characteristics of the AM broadcast wave and the FM broadcast wave were improved.

Second Embodiment

As shown in FIG. 2, in the second embodiment, in the upper blank space of the defogging heater strips 2 of the automotive rear window glass, there were provided the AM broadcast wave receiving antenna 4 and the FM broadcast wave receiving main and sub antennas 5, 5' of a frequency of 88 MHz-108 MHz for use outside Japan such as United States, Europe, and Australia.

Like the first embodiment, there were provided the AM broadcast wave receiving antenna 4, the FM broadcast wave receiving main antenna 5 and the FM broadcast wave receiving sub antenna 5'. The AM broadcast wave receiving antenna 4 includes seven horizontal strips provided in a space above the defogging heater strips, and two vertical strips perpendicular to the seven horizontal strips provided in a space above the defogging heater strips, and two vertical strips perpendicular to the seven horizontal strips. Each of the FM broadcast wave receiving main antenna 5 and the sub antenna 5' is substantially U-shape to sandwich the AM broadcast wave receiving antenna 4 from the both sides. The FM broadcast wave receiving main antenna 5 and the sub antenna 5' are provided near the AM broadcast wave receiving antenna 4.

Unlike the first embodiment, the number of the horizontal strips of the AM broadcast wave receiving antenna is seven. The lengths of the folded horizontal strips 5*c* of the FM broadcast wave receiving main antenna 5 is twice the lengths of the folded horizontal strips 5*c* of the FM broadcast wave receiving main antenna 5 of the first embodiment. The middle portions of the folded horizontal strips 5*c* are connected to form the closed loop. Moreover, the AM broadcast wave receiving antenna 4 includes a vertical strip 4*b*' extending in the upward direction. An L-shaped horizontal strip 4*a*' is provided at an upper end of the vertical strip 4*b*'. The horizontal strip 4*a*' is adjacent to the second horizontal strip 5*a*' of the FM broadcast wave receiving sub antenna 5' to achieve the capacitive coupling.

Moreover, lengths of the strips of the AM broadcast wave receiving antenna 4 according to the present invention are described below.

A length of the first horizontal strip 4*a* from the above=555 mm

Lengths of the second to the fifth horizontal strips 4*a* from the above=1,100 mm A length of the sixth horizontal strip 4*a* from the above=900 mm A length of the seventh horizontal strip 4*a* from the above=690 mm A length of the first horizontal strip 4*a*' from the above=345 mm Distances between the horizontal strips 4*a*=10 mm Lengths of the vertical strips 4*b*, 4*b*'=95 mm, 80 mm A distance between the vertical strips 4*b*, 4*b*'=310 mm Moreover, the length of each strip of the FM broadcast wave receiving antenna 5, 5' according to the present invention is as follows.

Lengths of the second horizontal strips 5*a*, 5*a*'=310 mm, 350 mm

Lengths of the second vertical strips 5*b*, 5*b*'=90 mm, 80 mm

Lengths of the folded horizontal strips 5*c*=700 mm, 700 mm

Lengths of the folded horizontal strips 5*c*'=390 mm, 390 mm

Distances between the second horizontal strips 5*a*, 5*a*' of the FM broadcast wave receiving antenna 5, 5' and the uppermost one of the horizontal strips 4*a*, 4*a*' of the AM broadcast wave receiving antenna 4, and distances between the upper one of the folded horizontal strips 5*c*, 5*c*, 5*c*' and 5*c*' of the FM broadcast wave receiving antenna 5, 5' and the lowermost one of the horizontal strips 4*a* of the AM broadcast wave receiving antenna 4 were, respectively, 5 mm.

Distances between the folded horizontal strips 5*c*, 5*c*' of the FM broadcast wave receiving antenna 5, 5' and the uppermost one of the heater strips 2*a* of the defogging heater strips 2 are 10 mm, like the first embodiment. The AM feed point 7, and the FM feed points 8, 8' are located at positions substantially identical to the first embodiment.

On the other hand, the second horizontal strip 5*a* of the FM broadcast wave receiving antenna 5 was adjacent to the uppermost one of the horizontal strips 4*a* of the AM broadcast wave receiving antenna 4 from the left end by 280 mm. The second horizontal strip 5*a*' of the FM broadcast wave receiving sub antenna 5' was adjacent to the uppermost one of the horizontal strips 4*a*' by 345 mm. The folded horizontal strip 5*c* was adjacent to the lowermost one of the horizontal strips 4*a* of the AM broadcast wave receiving antenna 4 from the left end by 690 mm. The folded horizontal strip 5*c*' was adjacent to the lowermost one of the horizontal strips 4*a* of the AM broadcast wave receiving antenna 4 from the right end by 380 mm.

The distance between the uppermost one of the horizontal strips 4*a* of the AM broadcast wave receiving antenna 4 and the inside of the upper side of the flange (not shown) was 30 mm. The distance between the lowermost one of the horizontal strips 4*a* and the uppermost one of the heater strips 2*a* was 20 mm.

The AM broadcast wave receiving antenna 4, the FM broadcast wave receiving main antenna 5, the FM broadcast wave receiving sub antenna 5', the heating conductive strips 2, the feed points, and the bus bars are formed by printing on the glass sheet by the conductive paste such as silver paste, and then baking.

Thus-obtained window glass sheet was mounted on the rear window glass of the vehicle. Likewise the first embodiment, the AM broadcast wave receiving antenna 4 was connected from the AM feed point to the tuner (not shown) by the feeder lines. The FM broadcast wave receiving antenna 5, 5' was connected from the FM feed points 8, 8' to the tuner (not shown) by the feeder lines.

Figure 6:
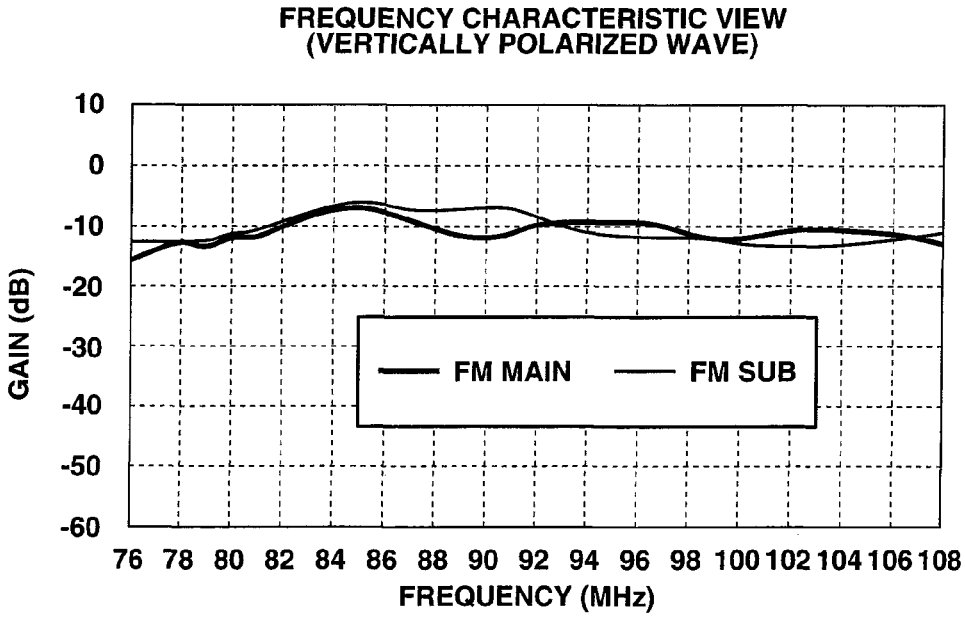
FIG. 6 is a frequency characteristic view of a vertically polarized wave in the second embodiment of the present invention.

As shown in FIG. 6, in case of receiving, respectively, by the FM main antenna 5 and the FM sub antenna 5', the average reception gains of the vertical polarized wave of the FM broadcast wave band of 88 MHz-108 MHz for the foreign use became, respectively −10.8 dBd, −11.0 dBd (the dipole antenna ratio). As a result of the diversity reception by the two FM antenna systems of the FM main antenna 5 and the FM sub antenna 5', the average reception gain of the vertically polarized wave of the FM broadcast wave band of 88 MHz-108 MHz became −9.7 dBd (the dipole antenna ratio). With this, it was understood that the average reception gain was greatly improved relative to the conventional antenna.

Since the AM broadcast waves are amplified by an AM broadcast wave band amplifier in a way similar to the past, it is practically not problematic at all.

As shown in FIG. 2, the horizontal strips 4*a*, 4*a*' of the AM broadcast wave receiving antenna are adjacent to the second horizontal strips 5*a*, 5*a*' or the folded horizontal strips 5*c*, 5*c*' of the FM broadcast wave receiving antenna to achieve the capacitive coupling. With this, the high reception characteristics of the AM broadcast wave and the FM broadcast wave are obtained.

Third Embodiment

A third embodiment shown in FIG. 3 is a variation example of the second embodiment. Each of the main antenna 5 and the sub antenna 5' of a frequency of 88-108 MHz for foreign use is a substantially U-shaped pattern. Each of the main antenna 5 and the sub antenna 5' is provided to surround the ends of the AM broadcast wave receiving antenna. Unlike the second embodiment, there are provided auxiliary horizontal strips 2*d* which branch off from the lowermost one of the defogging heater strips, and which are adjacent to the lower side of the opening portion of the body flange. As to the AM broadcast wave receiving antenna 4, the first horizontal strip 4*a* of the AM broadcast wave receiving antenna from the above is slightly short, relative to the second embodiment. As to the FM broadcast wave receiving antenna 5, the length of the one of the folded horizontal strips 5*c* of the FM broadcast wave receiving antenna 5 which is adjacent to the defogging heater strips is slightly short, relative to the second embodiment. The AM broadcast wave receiving antenna 4 and the FM broadcast wave receiving antenna 5 have patterns and sizes substantially identical to the patterns and the sizes of the second embodiment, except for the above-described differences.

The directional characteristic is considerably improved in the countries outside Japan such as North America and Europe in which the radio wave of the FM broadcast wave is the horizontally polarized wave and the vertically polarized wave, by providing the auxiliary horizontal strips 2*d* branching off from the lowermost one of the defogging heater strips, relative to the first and second embodiments in which the auxiliary horizontal strips 2*d* are not provided.

In case of receiving, respectively, by the FM main antenna 5 and the FM sub antenna 5' of this example, the average reception gains of the vertically polarized wave became, respectively, −10.2 dBd, −11.6 dBd (the dipole antenna ratio). As a result of the diversity reception by the two FM antenna systems of the FM main antenna 5 and the FM sub antenna 5', the average reception gain of the vertically polarized wave of the FM broadcast wave band became −7.7 dBd (the dipole antenna ratio). With this, it was understood that the average reception gain was greatly improved relative to the conventional antenna.

Since the AM broadcast waves are amplified by an AM broadcast wave band amplifier in a way similar to the past, it is practically not problematic at all.

As shown in FIG. 3, the horizontal strips 4*a*, 4*a'* of the AM broadcast wave receiving antenna are adjacent to the second horizontal strips 5*a*, 5*a'* or the folded horizontal strips 5*c*, 5*c'* of the FM broadcast wave receiving antenna to achieve the capacitive coupling. With this, the high reception characteristics of the AM broadcast wave and the FM broadcast wave are obtained.

Fourth Embodiment

A fourth embodiment shown in FIG. 4 is a variation example of the first embodiment. Each of the main antenna 5 and the sub antenna 5' for receiving the FM broadcast wave of a frequency of 76-90 MHz for the Japanese domestic use is a substantially U-shaped pattern. Each of the main antenna 5 and the sub antenna 5' is provided to surround all of the ends of the AM broadcast wave receiving antenna. Unlike the first embodiment, there are provided auxiliary horizontal strips 2*d* which branches off from the lowermost one of the defogging heater strips, and auxiliary vertical strips 2*c*, 2*c'* which extend in the upward direction from upper ends of the two bus bars 3, 3' of the defogging heater strips, and which are adjacent to the outsides of the second vertical strips 5*b*, 5*b'* and the second auxiliary strips 5*a*, 5*a'* of the FM broadcast wave receiving antenna 5, 5' to achieve the capacitive coupling. Other parts of the fourth embodiment are substantially identical to the parts of the first embodiment, except for the above-described differences.

The directional characteristic is considerably improved in the countries outside Japan such as North America and Europe in which the radio wave of the FM broadcast wave is the horizontally polarized wave and the vertically polarized wave, by providing the auxiliary horizontal strips 2*d* branching off from the lowermost one of the defogging heater strips, relative to the first and second embodiments in which the auxiliary horizontal strips 2*d* are not provided.

Moreover, the auxiliary vertical strips 2*c*, 2*c'* extending in the upward direction from the upper ends of the two bus bars of the defogging heater strips are adjacent to the outsides of the second vertical strips 5*b*, 5*b'* and the second horizontal strips 5*a*, 5*a'* of the FM broadcast wave receiving antenna to achieve the capacitive coupling. With this, the capacitive coupling with the defogger is increased, relative to the first to third embodiments in which the auxiliary vertical strips 2*c*, 2*c'* are not provided. Therefore, it is possible to effectively pick up the FM broadcast wave received by the defogger, and to considerably improve the reception characteristic.

In case of receiving, respectively, by the FM main antenna 5 and the FM sub antenna 5' of this example, the average reception gains of the horizontally polarized wave were substantially identical to the average reception gains of the first to third embodiments. With this, it was understood that the average reception gain was greatly improved relative to the conventional antenna.

Since the AM broadcast waves are amplified by an AM broadcast wave band amplifier in a way similar to the past, it is practically not problematic at all.

As shown in FIG. 4, the horizontal strips 4*a*, 4*a'* of the AM broadcast wave receiving antenna are adjacent to the second horizontal strips 5*a*, 5*a'* or the folded horizontal strips 5*c*, 5*c'* of the FM broadcast wave receiving antenna to achieve the capacitive coupling. With this, the high reception characteristics of the AM broadcast wave and the FM broadcast wave are obtained.

Fifth Embodiment

As shown in FIG. 7, the AM broadcast wave receiving antenna 4 and the FM broadcast wave receiving main and sub antennas 5, 5' of a frequency of 76 MHz-90 MHz for the Japanese domestic use are provided in an upper space of the defogging heater strips 2 of the rear window glass of the vehicle.

The AM broadcast wave receiving antenna 4 includes eight horizontal strips 4*a*, 4*a* . . . which are arranged with intervals; and two vertical strips 4*b*, 4*b'* which are orthogonal to the horizontal strips 4*a*, 4*a* . . . . The two vertical strips 4*b*, 4*b'* are provided at positions to divide substantially equally the horizontal strips 4*a* into three sections. One of the two vertical strips 4*b* was orthogonal to the eight horizontal strips 4*a*, 4*a* . . . from the uppermost one of the horizontal strips 4*a*, 4*a* . . . to the lowermost one of the horizontal strips 4*a*, 4*a* . . . . The other of the two vertical strips 4*b'* was orthogonal to the horizontal strips 4*a*, 4*a* . . . from the third horizontal strip from the top to the sixth horizontal strip from the top. Moreover, the AM broadcast wave receiving antenna 4 includes other horizontal strips 4*a'*, 4*a'* . . . which are different from the horizontal strips 4*a*, 4*a* . . . , and which extend from ends and midway portion of a vertical strip extending in the upward and downward directions from the upper and lower ends of the vertical strip 4*b'*. Moreover, an upper end of the vertical strip 4*b* was connected through an extension line to the AM feed point 7 provided above the AM broadcast wave receiving antenna 4.

As to the plurality of the horizontal strips 4*a*, 4*a* . . . , the lengths of the first horizontal strip and the second horizontal strip from the top, and the lengths of the first horizontal strip and the second horizontal strip from the bottom have the length shorter than the lengths of the horizontal strips 4*a*, 4*a* . . . in the middle portion. In the space formed by shortening the lengths of these horizontal strips, there are provided the other horizontal strips 4*a'*, 4*a'* . . . connected with the vertical strip 4*b'*. Lowermost one of the other horizontal strips 4*a'* is adjacent to uppermost one of the heater strips 2*a* to achieve the capacitive coupling.

On the other hand, the FM broadcast wave receiving main antenna 5 is a U-shaped antenna strip. The FM broadcast wave receiving main antenna 5 includes second horizontal strips 5*a*, a second vertical strip 5*b* and two folded horizontal strips 5*c*, 5*c*. The horizontal strips 5*a* extend in the counterclockwise direction from an FM feed point 8 provided near an upper end of the vertical strip 4*b* of the AM broadcast wave receiving antenna 4 and the AM feed point 7, along the uppermost one of the horizontal strips 4*a* of the AM broadcast wave receiving antenna 4. The second horizontal strips 5*a* are adjacent to each other to achieve the capacitive coupling. The second vertical strip 5*b* extends in the substantially vertical direction to surround the left side ends of all the horizontal strips 4*a*, 4*a* . . . of the AM broadcast wave receiving antenna 4. The two folded horizontal strips 5*c*, 5*c* are folded from the end of the second vertical strip 5*b*. The folded horizontal strips 5*c*, 5*c* are adjacent to the lowermost one of the horizontal strips 4*a* to achieve the capacitive coupling. The ends of the two second horizontal strips 5*a*, 5*a* are connected to form a closed loop.

The FM broadcast wave receiving sub antenna 5' is a substantially U-shaped antenna strip. The FM broadcast wave receiving sub antenna 5' includes second horizontal strips 5*a*', 5*a*', a second vertical strip 5*b*' and two folded horizontal strips 5*c*', 5*c*'. The second horizontal strips 5*a*', 5*a*' extend in the clockwise direction from the FM feed point 8' provided near the upper end of the vertical strip 4*b*' of the AM broadcast wave receiving antenna 4, along the uppermost one of the horizontal strips 4*a*' of the AM broadcast wave receiving antenna 4. The second horizontal strips 5*a*', 5*a*' are adjacent to each other to achieve the capacitive coupling. The second vertical strip 5*b*' extends in the substantially vertical direction to surround the right side ends of the second horizontal strips 4*a*', 4*a*' . . . , 4*a*, 4*a* . . . . The two folded horizontal strips 5*c*', 5*c*' are folded from the end of the second vertical strip 5*b*'. The two folded horizontal strips 5*c*', 5*c*' are adjacent to the lowermost one of the horizontal strips 4*a* to achieve the capacitive coupling. The ends of the two second horizontal strips 5*a*', 5*a*' are connected to form a closed loop.

The AM broadcast wave receiving antenna 4 was connected from the AM feed point 7 to a tuner (not shown). Likewise, the FM broadcast wave receiving antennas 5, 5' were connected from the FM feed point 8, 8' to a tuner (not shown).

The glass plate 1 has a substantially trapeziform shape. The glass plate 1 has outline dimensions of an upper side of 1,200 mm, a lower side of 1,360 mm, and a height of 500 mm. An inside size of the flange of the window flame are an upper side of 1,100 mm, a lower side of 1,100 mm and a height of 400 mm.

Moreover, lengths of the strips of the AM broadcast wave receiving antenna 4 according to the present invention are described below.

Lengths of the first and second horizontal strips 4*a* from the above=650 mm, 495 mm Lengths of the third to sixth horizontal strips 4*a* from the above=1,100 mm Lengths of the first and second horizontal strips from the below =650 mm, 650 mm Lengths of the first and second horizontal strips from the above=370 mm, 495 mm A length of the first horizontal strip from the below =400 mm Distances between the horizontal strips 4*a*=10 mm Lengths of the vertical strips 4*b*, 4*b*'=100 mm, 60 mm Distances between the vertical strips 4*b*, 4*b*'=310 mm Moreover, the length of each strip of the FM broadcast wave receiving antennas 5, 5' according to the present invention is as follows.

Lengths of the second horizontal strips 5*a*, 5*a*'=300 mm, 350 mm

Lengths of the second vertical strips 5*b*, 5*b*'=90 mm, 80 mm

Lengths of the folded horizontal strips 5*c*, 5*c*'=400 mm, 210 mm

Distances between the second horizontal strips 5*a*, 5*a*' of the FM broadcast wave receiving antenna 5, 5' and the uppermost one of the horizontal strips 4*a* of the AM broadcast wave receiving antenna 4, and distances between the folded horizontal strips 5*c*, 5*c*' of the FM broadcast wave receiving antenna 5' and the lowermost one of the horizontal strips 4*a* of the AM broadcast wave receiving antenna 4 were, respectively, 5 mm.

The AM feed point 7 is located at a position which is on the left side from the center line of the glass sheet 1 by 150 mm, and which is substantially on an extension line of the vertical strip 4*b* of the AM broadcast wave receiving antenna 4 and the vertical strip 2*b*' of the defogger 2.

On the other hand, the second horizontal strip 5*a* of the FM broadcast wave receiving main antenna 5 was adjacent to the uppermost one of the horizontal strips 4*a* of the AM broadcast wave receiving antenna 4 from the left end by 290 mm. The folded horizontal strip 5*c* is adjacent to the lowermost one of the horizontal strips 4*a* of the AM broadcast wave receiving antenna 4 from the left end by 400 mm.

Moreover, the second horizontal strip 5*a*' of the FM broadcast wave receiving sub antenna 5' was adjacent to the uppermost one of the horizontal strips 4*a*' of the AM broadcast wave receiving antenna 4 from the right end by 345 mm. The folded horizontal strip 5*c*' was adjacent to the lowermost one of the horizontal strips 4*a* of the AM broadcast wave receiving antenna 4 from the right end by 210 mm.

The distance between the uppermost one of the horizontal strips 4*a* of the AM broadcast wave receiving antenna 4 and the inside of the upper side of the body flange 9 was 30 mm. The distance between the lowermost one of the horizontal strips 4*a* and the uppermost one of the heater strips 2*a* was 20 mm.

The AM broadcast wave receiving antenna 4, the FM broadcast wave receiving main antenna 5, the FM broadcast wave receiving sub antenna 5', the heating conductive strips 2, the feed points 7, 8 and 8', and the bus bars 3, 3' are formed by printing on the glass sheet by the conductive paste such as silver paste, and then baking.

Thus-obtained window glass sheet was mounted on the rear window of the vehicle. The AM broadcast wave receiving antenna 4 was connected from the AM feed point to the tuner (not shown) by the feeder lines. The FM broadcast wave receiving antenna 5, 5' were connected from the FM feed points 8, 8' to the tuner (not shown) by the feeder lines.

The FM broadcast wave receiving main antenna 5 and the FM broadcast wave receiving sub antenna 5' are arranged to achieve the diversity reception or the phase diversity reception so as to improve the directional characteristic. Accordingly, either of the FM broadcast wave receiving antennas may be a main antenna.

Figure 11:
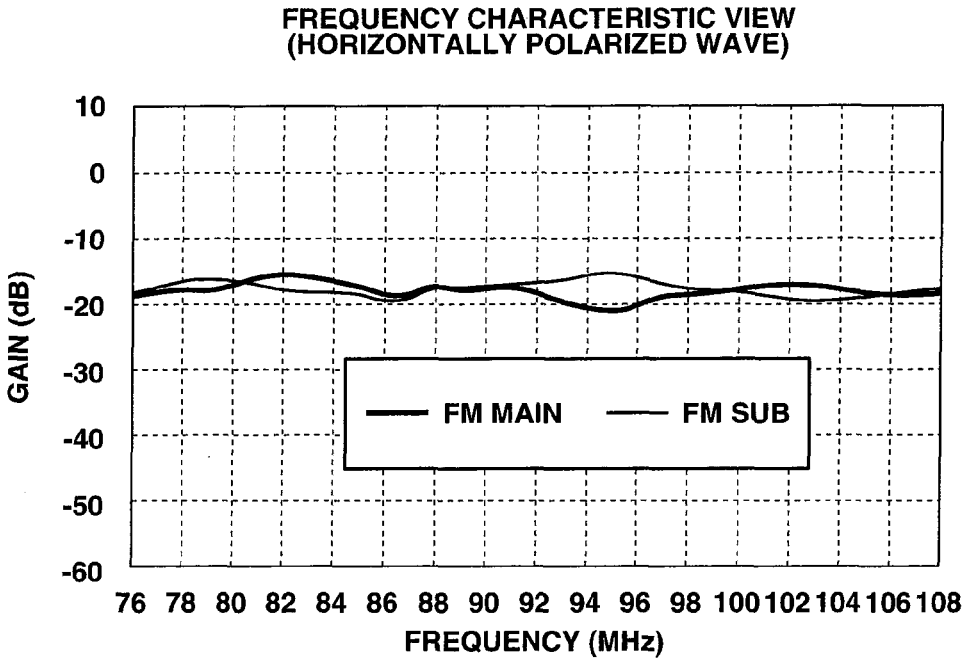
FIG. 11 is a frequency characteristic view of a horizontally polarized wave in the fifth embodiment of the present invention.

As shown in FIG. 11, in case of receiving, respectively, by the FM main antenna 5 and the FM sub antenna 5', the average reception gains of the horizontally polarized wave of the domestic FM broadcast wave band of 76 MHz-90 MHz became, respectively, −17.4 dBd, −17.7 dBd (the dipole antenna ratio). As a result of the diversity reception by the two FM antenna systems of the FM main antenna 5 and the FM sub antenna 5', the average reception gain of the horizontally polarized wave of the domestic FM broadcast wave band of 76 MHz-90 MHz became −13.9 dBd (the dipole antenna ratio). With this, it was found to obtain a very good reception gain relative to the conventional antenna.

Since the AM broadcast waves are amplified by an AM broadcast wave band amplifier in a way similar to the past, it is practically not problematic at all.

As shown in FIG. 7, the horizontal strip of the AM broadcast wave receiving antenna was adjacent to the second horizontal strip of the FM broadcast wave receiving antenna to achieve the capacitive coupling. With this, the reception characteristics of the AM broadcast wave and the FM broadcast wave are improved.

Sixth Embodiment

Figure 8:
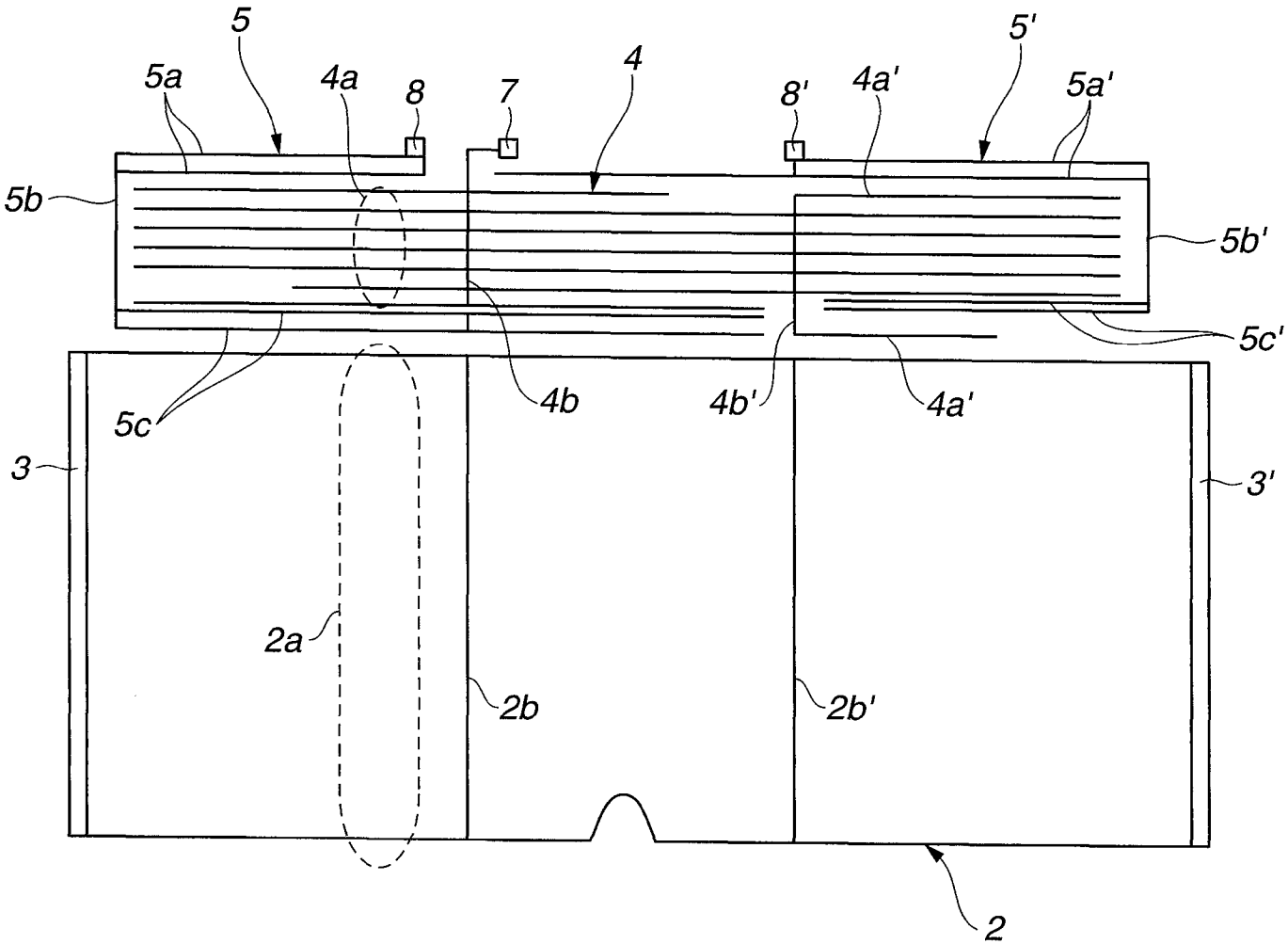
FIG. 8 is a front view showing a glass antenna provided to a rear window glass for a vehicle, according to a sixth embodiment of the present invention.

As shown in FIG. 8, in the sixth embodiment, in the upper space of the defogging heater strips 2 of the automotive rear window glass, there are provided the AM broadcast wave receiving antenna 4 and FM broadcast wave receiving main and sub antenna 5, 5' of a frequency of 88 MHz-108 MHz for foreign use such as United States, Europe, and Australia.

Likewise the fifth embodiment, there are provided the AM broadcast wave receiving antenna 4, the FM broadcast wave receiving main antenna 5 and the FM broadcast wave receiving sub antenna 5'. The AM broadcast wave receiving antenna 4 includes seven horizontal strips provided in a space above the defogging heater strips, and two vertical strips perpendicular to the seven horizontal strips. Each of the FM broadcast wave receiving main antenna 5 and the sub antenna 5' is substantially U-shape to sandwich the AM broadcast wave receiving antenna 4 from the both sides. The FM broadcast wave receiving main antenna 5 and the sub antenna 5' are provided near the AM broadcast wave receiving antenna 4.

Unlike the fifth embodiment, the number of the horizontal strips of the AM broadcast wave receiving antenna is seven. The lengths of the folded horizontal strips 5*c* of the FM broadcast wave receiving main antenna 5 is twice the length of the folded horizontal strips 5*c* of the FM broadcast wave receiving main antenna 5 of the fifth embodiment. The midway portions of the folded horizontal strips 5*c* are connected to form the closed loop. Moreover, the AM broadcast wave receiving antenna 4 includes a vertical strip 4*b'* extending in the downward direction. An L-shaped horizontal strip 4*a'* is provided at an upper end of the vertical strip 4*b'*. This horizontal strip 4*a'* was adjacent to the second horizontal strip 5*a'* of the FM broadcast wave receiving sub antenna 5' to achieve the capacitive coupling. Moreover, an L-shape horizontal strip 4*a'* is provided at a lower end of the vertical strip 4*b'*. This horizontal strip 4*a'* was adjacent to the uppermost one of the horizontal strips of the defogging heater strips to achieve the capacitive coupling.

Moreover, lengths of the strips of the AM broadcast wave receiving antenna 4 according to the present invention are described below.

A length of the first horizontal strip 4*a* from the above=555 mm

Lengths of the second to the fifth horizontal strips 4*a* from the above=1,100 mm A length of the sixth horizontal strip 4*a* from the above=900 mm A length of the seventh horizontal strip 4*a* from the above=690 mm A length of the first horizontal strip 4*a'* from the above=345 mm A length of lowermost one of the horizontal strips 4*a'*=195 mm Distances between the horizontal strips 4*a*=10 mm Lengths of the vertical strips 4*b*, 4*b*7=95 mm, 60 mm A distance between the vertical strips 4*b*, 4*b'*=310 mm Moreover, the length of each strip of the FM broadcast wave receiving antenna 5, 5' according to the present invention is as follows.

Lengths of the second horizontal strips 5*a*, 5*a'*=310 mm, 350 mm

Lengths of the second vertical strips 5*b*, 5*b'*=90 mm, 80 mm

Lengths of the folded horizontal strips 5*c*=800 mm, 700 mm

Lengths of the folded horizontal strips 5*c'*=390 mm, 390 mm

Distances between the second horizontal strips 5*a*, 5*a'* of the FM broadcast wave receiving antenna 5, 5' and the uppermost one of the horizontal strips 4*a*, 4*a'* of the AM broadcast wave receiving antenna 4, and distances between the upper one of the folded horizontal strips 5*c*, 5*c*, 5*c'* and 5*c'* of the FM broadcast wave receiving antenna 5, 5' and the lowermost one of the horizontal strips 4*a* of the AM broadcast wave receiving antenna 4 were, respectively, 5 mm.

A distance between the folded horizontal strips 5*c*, 5*c'* of the FM broadcast wave receiving antenna 5, 5' and the uppermost one of the heater strips 2*a* of the defogging heater strips 2 is 10 mm, like the fifth embodiment. The AM feed point 7, and the FM feed points 8, 8' are located at positions substantially identical to the fifth embodiment.

On the other hand, the second horizontal strip 5*a* of the FM broadcast wave receiving antenna 5 was adjacent to the uppermost one of the horizontal strips 4*a* of the AM broadcast wave receiving antenna 4 from the left end by 280 mm. The second horizontal strip 5*a'* of the FM broadcast wave receiving sub antenna 5' was adjacent to the uppermost one of the horizontal strips 4*a'* by 345 mm. The folded horizontal strip 5*c* was adjacent to the lowermost one of the horizontal strips 4*a* of the AM broadcast wave receiving antenna 4 from the left end by 690 mm. The folded horizontal strip 5*c'* was adjacent to the lowermost one of the horizontal strips 4*a* of the AM broadcast wave receiving antenna 4 from the right end by 380 mm.

The distance between the uppermost one of the horizontal strips 4*a* of the AM broadcast wave receiving antenna 4 and the inside of the upper side of the flange (not shown) was 30 mm. The distance between the lowermost one of the horizontal strips 4*a* and the uppermost one of the heater strips 2*a* was 20 mm.

The AM broadcast wave receiving antenna 4, the FM broadcast wave receiving main antenna 5, the FM broadcast wave receiving sub antenna 5', the heating conductive strips 2, the feed points, and the bus bars are formed by printing on the glass sheet by the conductive paste such as silver paste, and then baking.

Thus-obtained window glass sheet was mounted on the rear window glass of the vehicle. Like the fifth embodiment, the AM broadcast wave receiving antenna 4 was connected from the AM feed point to the tuner (not shown) by the feeder lines. The FM broadcast wave receiving antenna 5, 5' was connected from the FM feed points 8, 8' to the tuner (not shown) by the feeder lines.

Figure 12:
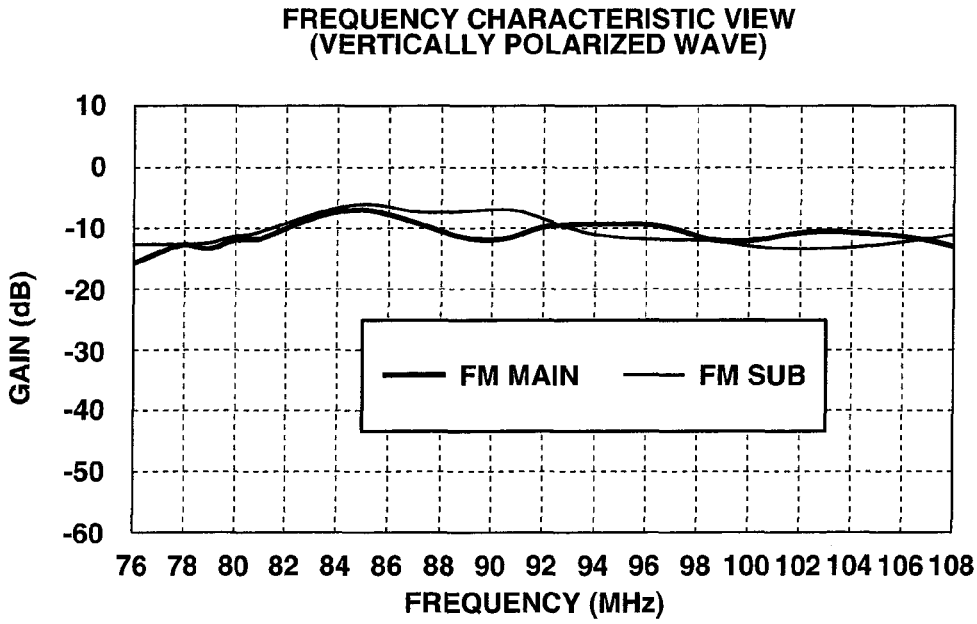
FIG. 12 is a frequency characteristic view of a vertically polarized wave in the sixth embodiment of the present invention.

As shown in FIG. 12, in case of receiving, respectively, by the FM main antenna 5 and the FM sub antenna 5', the average reception gains of the vertically polarized wave of the FM broadcast wave band of 88 MHz-108 MHz for the foreign use became, respectively, −10.9 dBd, −11.1 dBd (the dipole antenna ratio). As a result of the diversity reception by the two FM antenna systems of the FM main antenna 5 and the FM sub antenna 5', the average reception gain of the vertically polarized wave of the FM broadcast wave band of 88 MHz-108 MHz became −7.7 dBd (the dipole antenna ratio). With this, it was understood that the average reception gain was greatly improved relative to the conventional antenna.

Since the AM broadcast waves are amplified by an AM broadcast wave band amplifier in a way similar to the past, it is practically not problematic at all.

As shown in FIG. 8, the horizontal strips 4*a*, 4*a'* of the AM broadcast wave receiving antenna are adjacent to the second horizontal strips 5*a*, 5*a'* or the folded horizontal strips 5*c*, 5*c'* of the FM broadcast wave receiving antenna to achieve the capacitive coupling. With this, the high reception characteristics of the AM broadcast wave and the FM broadcast wave are obtained.

Seventh Embodiment

Figure 9:
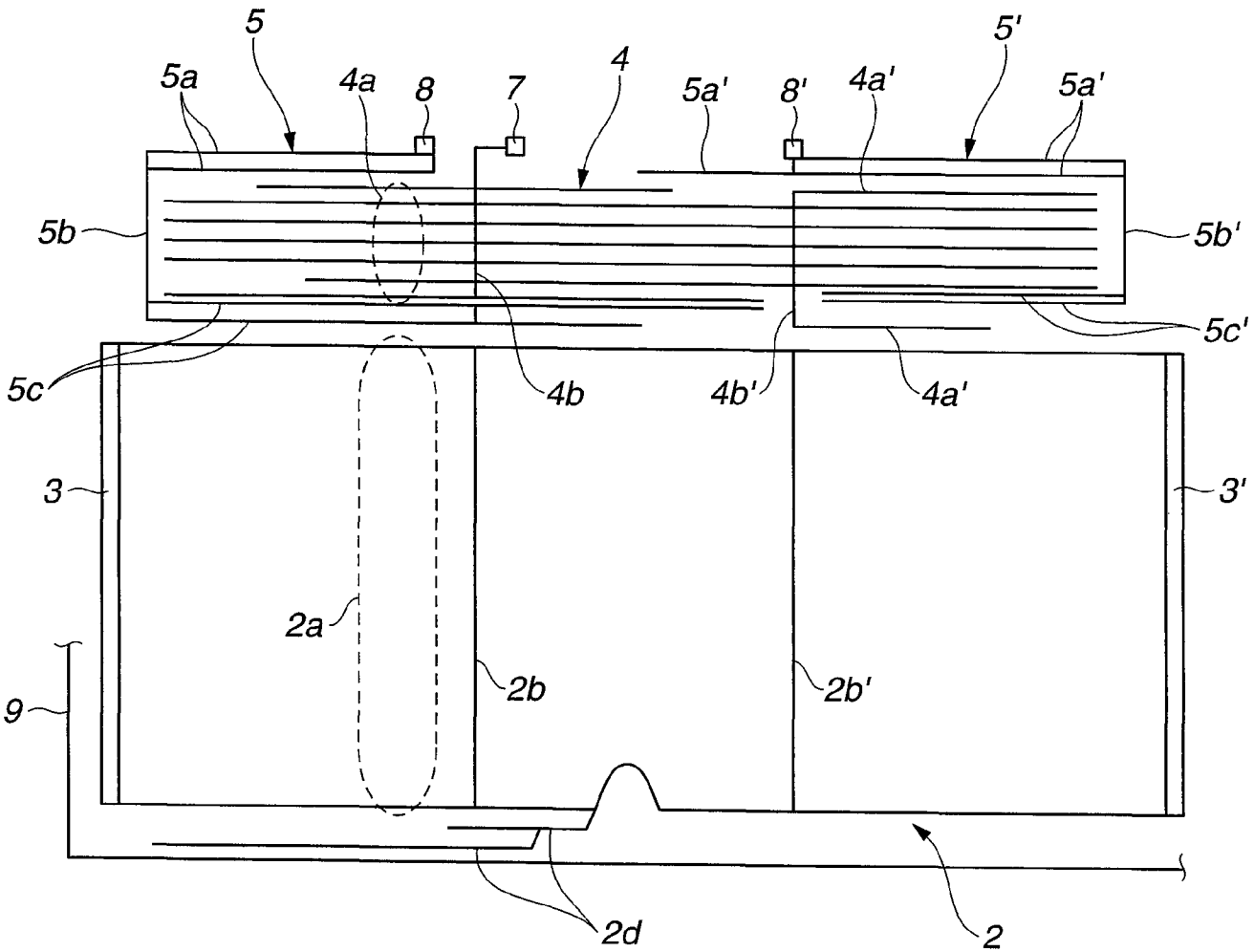
FIG. 9 is a front view showing a glass antenna provided to a rear window glass for a vehicle, according to a seventh embodiment of the present invention.

A seventh embodiment shown in FIG. 9 is a variation example of the sixth embodiment. Each of the main antenna 5 and the sub antenna 5' of a frequency of 88-108 MHz for foreign use is a substantially U-shaped pattern. Each of the main antenna 5 and the sub antenna 5' is provided to surround the ends of the AM broadcast wave receiving antenna. Unlike the sixth embodiment, there are provided auxiliary horizontal strips 2*d* which branch off from the lowermost one of the defogging heater strips, and which are adjacent to the lower side of the opening portion of the body flange. As to the AM broadcast wave receiving antenna 4, the first horizontal strip 4*a* of the AM broadcast wave receiving antenna from the above is slightly short, relative to the sixth embodiment. As to the FM broadcast wave receiving antenna 5, the length of the one of the folded horizontal strips 5*c* of the FM broadcast wave receiving antenna 5 which is adjacent to the defogging heater strips is slightly short, relative to the sixth embodiment. The AM broadcast wave receiving antenna 4 and the FM broadcast wave receiving antenna 5 have patterns and sizes substantially identical to the patterns and the sizes of the second embodiment, except for the above-described differences.

The directional characteristic is considerably improved in the countries outside Japan such as North America and Europe in which the radio wave of the FM broadcast wave is the horizontally polarized wave and the vertically polarized wave, by providing the auxiliary horizontal strips 2*d* branching off from the lowermost one of the defogging heater strips, relative to the sixth and seventh embodiments in which the auxiliary horizontal strips 2*d* are not provided.

In case of receiving, respectively, by the FM main antenna 5 and the FM sub antenna 5' of this example, the average reception gains of the vertically polarized wave became, respectively, −12.5 dBd, −11.8 dBd (the dipole antenna ratio). As a result of the diversity reception by the two FM antenna systems of the FM main antenna 5 and the FM sub antenna 5', the average reception gain of the vertically polarized wave of the FM broadcast wave band became −8.9 dBd (the dipole antenna ratio). With this, it was understood that the average reception gain was greatly improved relative to the conventional antenna.

Since the AM broadcast waves are amplified by an AM broadcast wave band amplifier in a way similar to the past, it is practically not problematic at all.

As shown in FIG. 9, the horizontal strips 4*a*, 4*a*' of the AM broadcast wave receiving antenna are adjacent to the second horizontal strips 5*a*, 5*a*' or the folded horizontal strips 5*c*, 5*c*' of the FM broadcast wave receiving antenna to achieve the capacitive coupling. With this, the high reception characteristics of the AM broadcast wave and the FM broadcast wave are obtained.

Eighth Embodiment

A fourth embodiment shown in FIG. 10 is a variation of the fifth embodiment. Each of the main antenna 5 and the sub antenna 5' for receiving the FM broadcast wave of a frequency of 76-90 MHz for the Japanese domestic use is a substantially U-shaped pattern. Each of the main antenna 5 and the sub antenna 5' is provided to surround the ends of the AM broadcast wave receiving antenna from the side. Unlike the fifth embodiment, there are provided auxiliary horizontal strips 2*d* which branches off from the lowermost one of the defogging heater strips, and auxiliary vertical strips 2*c*, 2*c*' which extend in the upward direction from upper ends of the two bus bars 3, 3' of the defogging heater strips, and which are adjacent to the outsides of the second vertical strips 5*b*, 5*b*' and the second auxiliary strips 5*a*, 5*a*' of the FM broadcast wave receiving antenna 5, 5' to achieve the capacitive coupling. Other parts of the eighth embodiment are substantially identical to the parts of the fifth embodiment, except for the above-described differences.

The directional characteristic is considerably improved in the countries outside Japan such as North America and Europe in which the radio wave of the FM broadcast wave is the horizontally polarized wave and the vertically polarized wave, by providing the auxiliary horizontal strips 2*d* branching off from the lowermost one of the defogging heater strips, relative to the first and second embodiments in which the auxiliary horizontal strips 2*d* are not provided.

Moreover, the auxiliary vertical strips 2*c*, 2*c*' extending in the upward direction from the upper ends of the two bus bars of the defogging heater strips are adjacent to the outsides of the second vertical strips 5*b*, 5*b*' and the second horizontal strips 5*a*, 5*a*' of the FM broadcast wave receiving antenna to achieve the capacitive coupling. With this, the capacitive coupling with the defogger is increased, relative to the fifth to seventh embodiments in which the auxiliary vertical strips 2*c*, 2*c*' are not provided. Therefore, it is possible to effectively pick up the FM broadcast wave received by the defogger, and to considerably improve the reception characteristic.

In case of receiving, respectively, by the FM main antenna 5 and the FM sub antenna 5' of this example, the average reception gains of the horizontally polarized wave were substantially identical to the average reception gains of the fifth to seventh embodiments. With this, it was understood that the average reception gain was greatly improved relative to the conventional antenna.

Since the AM broadcast waves are amplified by an AM broadcast wave band amplifier in a way similar to the past, it is practically not problematic at all.

As shown in FIG. 10, the horizontal strips 4*a*, 4*a*' of the AM broadcast wave receiving antenna are adjacent to the second horizontal strips 5*a*, 5*a*' or the folded horizontal strips 5*c*, 5*c*' of the FM broadcast wave receiving antenna to achieve the capacitive coupling. With this, the high reception characteristics of the AM broadcast wave and the FM broadcast wave are obtained.

The invention claimed is:

1. A vehicular glass antenna which is provided in an upper blank space of defogging heater strips of a rear window glass of the vehicle, the vehicular glass antenna comprising:

an AM broadcast wave receiving antenna including;

a plurality of horizontal strips arranged at intervals, at least two vertical strips which are orthogonal to the horizontal strips, and which are apart from each other, and an AM feed point located between the vertical strips, on uppermost one of the horizontal strips or through an extension line extending from a portion of the uppermost one of the horizontal strips, and two FM broadcast wave receiving antennas extending, respectively, from two FM feed points provided above the uppermost one of the horizontal strips of the AM broadcast wave receiving antenna on left and right sides of the AM feed point, along a part of an outermost portion of the AM broadcast wave receiving antenna, the FM broadcast wave receiving antennas extending, respectively, in opposite directions of a clockwise direction and a counterclockwise direction, one of the FM broadcast wave receiving antennas which has a substantially U-shape, and which surrounds all of ends of the plurality of the horizontal strips of the AM broadcast wave receiving antenna on one side, the other of the FM broadcast wave receiving antennas which has a substantially U-shape, and which surrounds a part of ends of the plurality of the horizontal strips on the other side, and each of the two FM broadcast wave receiving antennas including a second horizontal strip which is adjacent to the horizontal strips of the AM broadcast wave receiving antenna to achieve a capacitive coupling between the horizontal strips of the two FM broadcast wave receiving antennas and the horizontal strips of the AM broadcast wave receiving antenna, wherein the horizontal strips of the FM broadcast wave receiving antennas which extend, respectively, from the two FM feed points horizontally in opposite directions are adjacent to the horizontal strips of the AM broadcast wave receiving antenna to achieve the capacitive coupling between the horizontal strips of the FM broadcast wave receiving antennas and the horizontal strips of the AM broadcast wave receiving antenna, each of the FM broadcast wave receiving antennas includes at least a vertical strip extending from an end of one of the horizontal strips in a substantially vertical direction or in an arc shape along outsides of the plurality of the horizontal strips of the AM broadcast wave receiving antenna, wherein each of the FM broadcast wave receiving antennas includes one or a plurality of folded horizontal strips which is formed by folding an end of the FM broadcast wave receiving antenna, and which is adjacent to the horizontal state strips of the AM broadcast wave receiving antenna for receiving the AM broadcast wave to achieve a capacitive coupling between the one or the plurality of the folded horizontal strips of the FM broadcast wave receiving antennas, and the horizontal strips of the AM broadcast wave receiving antenna, and wherein each of the FM broadcast wave receiving antennas wraps around the ends of the plurality of the horizontal strips of the AM broadcast wave receiving antenna.

2. The vehicular glass antenna as defined in claim 1, wherein a distance between centers of terminals of the two FM broadcast feed points is equal to or greater than 100 mm, and equal to or smaller than 400 mm.

3. The vehicular glass antenna as defined in claim 1, wherein a distance between a center of the AM feed point and a center of the FM broadcast feed point is equal to or greater than 50 mm, and equal to or smaller than 350 mm.

4. The vehicular glass antenna as defined in claim 1, wherein the FM broadcast wave receiving antenna has a loop shape.

5. The vehicular glass antenna as defined in claim 4, wherein the loop shape of the FM broadcast wave receiving antenna is located in a position above the AM broadcast wave receiving antenna or in a position below the AM broadcast wave receiving antenna, or both in the positions above and below the AM broadcast wave receiving antenna.

6. The vehicular glass antenna as defined in claim 1, wherein the FM broadcast wave receiving antennas of the two systems are arranged to achieve a diversity reception or phase diversity reception.

7. The vehicular glass antenna as defined in claim 1, wherein the horizontal strip of the AM broadcast wave receiving antenna is adjacent to a horizontal strip of the defogging heater strips to achieve a capacitive coupling between the horizontal strip of the AM broadcast wave receiving antenna and the horizontal strip of the defogging heater strips.

8. The vehicular glass antenna as defined in claim 1, wherein an auxiliary vertical strip extending in the upward direction from an upper end of a bus bar of the defogging heater strips is adjacent to and along an outside of the vertical strip of the FM broadcast wave receiving antenna to achieve a capacitive coupling between the auxiliary vertical strip of the defogging heater strips and the vertical strip of the FM broadcast wave receiving antenna.

9. The vehicular glass antenna as defined in claim 1, wherein the vehicular glass antenna comprises at least a horizontal auxiliary strip which branches from a substantially middle portion of a lowermost one of the heater strips of the defogging heater strips, and which extends in one of left and right directions of the horizontal direction, or in both of the left and right directions.

10. The vehicular glass antenna as defined in claim 9, wherein the lowermost one of the auxiliary horizontal strips is adjacent to an opening portion of a flange of the vehicle body in which the rear window glass is mounted to achieve a capacitive coupling between the lowermost one of the auxiliary horizontal strips of the defogging heater strips and the flange of the vehicle body in which the rear window glass is mounted.

11. The vehicular glass antenna as defined in claim 1, wherein the FM broadcast wave receiving antenna from the FM feed point to an end has an entire antenna length of 800-2,500 mm in case of the FM broadcast wave receiving antenna of a frequency of 76-90 MHz for Japanese domestic use, and in case of the FM broadcast wave receiving antenna of a frequency of 88-108 MHz for use outside Japan; a sum of a length of a portion of the horizontal strip of the FM broadcast wave receiving antenna which is adjacent to the uppermost one of the horizontal strips of the AM broadcast wave receiving antenna to achieve the capacitive coupling between the horizontal strip of the FM broadcast wave receiving antenna and the uppermost one of the horizontal strips of the AM broadcast wave receiving antenna, and a length of a portion of the uppermost one of the horizontal strips of the AM broadcast wave receiving antenna which is adjacent to the horizontal strip of the FM broadcast wave receiving antenna to achieve the capacitive coupling between the horizontal strip of the FM broadcast wave receiving antenna and the uppermost one of the horizontal strips of the AM broadcast wave receiving antenna is 800 mm-2,500 mm in case of the FM broadcast wave receiving antenna of a frequency of 76-90 MHz for Japanese domestic use, and also in case of the FM broadcast wave receiving antenna of a frequency of 88-108 MHz for use outside Japan; and a distance of the portion of the horizontal strip of the FM broadcast wave receiving antenna which is adjacent to the uppermost one of the horizontal strips of the AM broadcast wave receiving antenna to achieve the capacitive coupling between the horizontal strip of the FM broadcast wave receiving antenna and the uppermost one of the horizontal strips of the AM broadcast wave receiving antenna, and the portion of the uppermost one of the horizontal strips of the AM broadcast wave receiving antenna which is adjacent to the horizontal strip of the FM broadcast wave receiving antenna to achieve the capacitive coupling between the uppermost one of the horizontal strips of the AM broadcast wave receiving antenna and the horizontal strip of the FM broadcast wave receiving antenna is 2-30 mm in case of the FM broadcast wave receiving antenna of a frequency of 76-90 MHz for Japanese domestic use, and in case of the FM broadcast wave receiving antenna of a frequency of 88-108 MHz for use outside Japan.

12. The vehicular glass antenna as defined in claim 1, wherein the vehicular glass antenna includes at least a vertical strip crossing the plurality of the horizontal strips of the defogging heater strips.

13. A vehicular glass antenna which is provided in an upper blank space of defogging heater strips of a rear window glass of the vehicle, the vehicular glass antenna comprising:

an AM broadcast wave receiving antenna including;

a plurality of horizontal strips arranged at intervals, at least two vertical strips which are orthogonal to the horizontal strips, and which are apart from each other, and an AM feed point located between the vertical strips, on uppermost one of the horizontal strips or through an extension line extending from a portion of the uppermost one of the horizontal strips, and two FM broadcast wave receiving antennas extending, respectively, from two FM feed points provided above the uppermost one of the horizontal strips of the AM broadcast wave receiving antenna on left and right sides of the AM feed point, along a part of an outermost portion of the AM broadcast wave receiving antenna, the FM broadcast wave receiving antennas extending, respectively, in opposite directions of a clockwise direction and a counterclockwise direction, the pair of the left and right FM broadcast wave receiving antennas including a pair of left and right vertical strips which have different lengths, the vertical strips sandwiching and surrounding portions near both ends of the horizontal strips of the AM broadcast wave receiving antenna on outermost sides, the pair of the left and right FM broadcast wave receiving antennas being adjacent to the horizontal strips of the AM broadcast wave receiving antenna to achieve the a capacitive coupling between the pair of the left and right FM broadcast wave receiving antennas and the horizontal strips of the AM broadcast wave receiving antenna, wherein the FM broadcast wave receiving antennas includes, respectively, horizontal strips of the FM broadcast wave receiving antennas which extend, respectively, from the two FM feed points horizontally in opposite directions, and which are adjacent to the horizontal strips of the AM broadcast wave receiving antenna to achieve the capacitive coupling between the horizontal strips of the FM broadcast wave receiving antennas and the horizontal strips of the AM broadcast wave receiving antenna, each of the vertical strip of the FM broadcast wave receiving antenna extends from an end of one of the horizontal strips in a substantially vertical direction or in an arc shape along outsides of the plurality of the horizontal strips of the AM broadcast wave receiving antenna, and each of the FM broadcast wave receiving antennas has a U-shape, wherein each of the FM broadcast wave receiving antennas includes one or a plurality of folded horizontal strips which is formed by folding an end of the FM broadcast wave receiving antenna, and which is adjacent to the horizontal strips of the AM broadcast wave receiving antenna for receiving the AM broadcast wave to achieve a capacitive coupling between the one or the plurality of the folded horizontal strips of the FM broadcast wave receiving antennas, and the horizontal strips of the AM broadcast wave receiving antenna, and wherein each of the FM broadcast wave receiving antennas wraps around the ends of the plurality of the horizontal strips of the AM broadcast wave receiving antenna.

14. The vehicular glass antenna as defined in claim 13, wherein a distance between centers of terminals of the two FM broadcast feed points is equal to or greater than 100 mm, and equal to or smaller than 400 mm.

15. The vehicular glass antenna as defined in claim 13, wherein a distance between a center of the AM feed point and a center of the FM broadcast feed point is equal to or greater than 50 mm, and equal to or smaller than 350 mm.

16. The vehicular glass antenna as defined in claim 13 wherein the FM broadcast wave receiving antenna has a loop shape.

17. The vehicular glass antenna as defined in claim 16, wherein the loop shape of the FM broadcast wave receiving antenna is located in a position above the AM broadcast wave receiving antenna or in a position below the AM broadcast wave receiving antenna, or both in the positions above and below the AM broadcast wave receiving antenna.

18. The vehicular glass antenna as defined in claim 13, wherein the FM broadcast wave receiving antennas of the two systems are arranged to achieve a diversity reception or phase diversity reception.

19. The vehicular glass antenna as defined in claim 13, wherein the horizontal strip of the AM broadcast wave receiving antenna is adjacent to a horizontal strip of the defogging heater strips to achieve a capacitive coupling between the horizontal strip of the AM broadcast wave receiving antenna and the horizontal strip of the defogging heater strips.

20. The vehicular glass antenna as defined in claim 13, wherein an auxiliary vertical strip extending in the upward direction from an upper end of a bus bar of the defogging heater strips is adjacent to and along an outside of the vertical strip of the FM broadcast wave receiving antenna to achieve a capacitive coupling between the auxiliary vertical strip of the defogging heater strips and the vertical strip of the FM broadcast wave receiving antenna.

21. The vehicular glass antenna as defined in claim 13, wherein the vehicular glass antenna comprises at least a horizontal auxiliary strip which branches from a substantially middle portion of a lowermost one of the heater strips of the defogging heater strips, and which extends in one of left and right directions of the horizontal direction, or in both of the left and right directions.

22. The vehicular glass antenna as defined in claim 21, wherein the lowermost one of the auxiliary horizontal strips is adjacent to an opening portion of a flange of a vehicle body in which the rear window glass is mounted to achieve a capacitive coupling horizontal strips of the defogging heater strips and the flange of the vehicle body in which the rear window glass is mounted.

23. The vehicular glass antenna as defined in claim 13, wherein the FM broadcast wave receiving antenna from the FM feed point to an end has an entire antenna length of 800-2,500 mm in case of the FM broadcast wave receiving antenna of a frequency of 76-90 MHz for Japanese domestic use, and in case of the FM broadcast wave receiving antenna of a frequency of 88-108 MHz for use outside Japan; a sum of a length of of a portion of the horizontal strip of the FM broadcast wave receiving antenna which is adjacent to the uppermost one of the horizontal strips of the AM broadcast wave receiving antenna to achieve the capacitive coupling between the horizontal strip of the FM broadcast wave receiving antenna and the uppermost one of the horizontal strips of the AM broadcast wave receiving antenna, and a length of a portion of the uppermost one of the horizontal strips of the AM broadcast wave receiving antenna which is adjacent to the horizontal strip of the FM broadcast wave receiving antenna to achieve the capacitive coupling between the horizontal strip of the FM broadcast wave receiving antenna and the uppermost one of the horizontal strips of the AM broadcast wave receiving antenna is 800 mm-2,500 mm in case of the FM broadcast wave receiving antenna of a frequency of 76-90 MHz for Japanese domestic use, and also in case of the FM broadcast wave receiving antenna of a frequency of 88-108 MHz for use outside Japan; and a distance between the portion of the horizontal strip of the FM broadcast wave receiving antenna which is adjacent to the uppermost one of the horizontal strips of the AM broadcast wave receiving antenna to achieve the capacitive coupling between the horizontal strip of the FM broadcast wave receiving antenna and the uppermost one of the horizontal strips of the AM broadcast wave receiving antenna, and the portion of the uppermost one of the horizontal strips of the AM broadcast wave receiving antenna which is adjacent to the horizontal strip of the FM broadcast wave receiving antenna to achieve the capacitive coupling between the uppermost one of the horizontal strips of the AM broadcast wave receiving antenna and the horizontal strip of the FM broadcast wave receiving antenna is 2-30 mm in case of the FM broadcast wave receiving antenna of a frequency of 76-90 MHz for Japanese domestic use, and in case of the FM broadcast wave receiving antenna of a frequency of 88-108 MHz for use outside Japan.

24. The vehicular glass antenna as defined in claim 13, wherein the vehicular glass antenna includes at least a vertical strip crossing the plurality of the horizontal strips of the defogging heater strips.

* * * * *